United States Patent [19]

Seto et al.

[11] Patent Number: 4,895,793

[45] Date of Patent: Jan. 23, 1990

[54] SILVER HALIDE COLOR PHOTOGRAPHIC MATERIAL

[75] Inventors: Nobuo Seto; Masakazu Morigaki, both of Minami-ashigara, Japan

[73] Assignee: Fuji Photo Film Co., Ltd., Kanagawa, Japan

[21] Appl. No.: 38,669

[22] Filed: Apr. 15, 1987

[30] Foreign Application Priority Data

Apr. 16, 1986 [JP] Japan ..... 61-87803

[51] Int. Cl.[4] ..... G03C 7/32; G03C 7/38

[52] U.S. Cl. ..... 430/548; 430/372; 430/607; 430/551

[58] Field of Search ..... 430/551, 372, 607, 548

[56] References Cited

U.S. PATENT DOCUMENTS

| | | | |
|---|---|---|---|
| 3,764,337 | 10/1973 | Arai et al. | 430/551 |
| 3,930,866 | 1/1976 | Oishi et al. | 430/551 |
| 4,113,488 | 9/1978 | Yamada et al. | 430/551 |
| 4,268,621 | 5/1981 | Ogi et al. | 430/551 |
| 4,360,589 | 11/1982 | Kojima et al. | 430/551 |
| 4,385,111 | 5/1983 | Nakamura et al. | 430/551 |
| 4,416,978 | 11/1983 | Morigaki et al. | 430/551 |

FOREIGN PATENT DOCUMENTS

| | | | |
|---|---|---|---|
| 0164130 | 12/1985 | European Pat. Off. | 430/551 |
| 44521 | 4/1979 | Japan . | |

*Primary Examiner*—Richard L. Schilling

*Attorney, Agent, or Firm*—Birch, Stewart, Kolasch & Birch

[57] ABSTRACT

A silver halide color photographic material, wherein a dye stabilizer as described in the claims is contained in a photographic layer such as a coupler-containing silver halide photosensitive emulsion layer. The dye images obtained eventually by developing the photographic material have improved fading or discoloring characteristics.

19 Claims, No Drawings

SILVER HALIDE COLOR PHOTOGRAPHIC MATERIAL

BACKGROUND OF THE INVENTION (1) Field of the Invention

The present invention relates to a color photographic material, particularly to the prevention of fading and discoloring of the dye image eventually obtained by developing a color photographic material, and more particularly to a dibenzospiroindane type fading preventive agent.

(2) Description of the Prior Art

Generally, a dye image obtained by subjecting a silver halide color photographic material to photographic processing is made up of an azomethine dye or an indoaniline dye formed by a reaction of a coupler with the oxidation product of an aromatic primary amine developing agent. The color photographic images obtained in this manner are not necessarily stable to light and moist heat, and when the color photographic images are exposed to light for a prolonged period of time or are preserved under high temperatures and high humidities, the dye images may be faded or discolored, resulting in deterioration of the image quality.

Such fading of images is an almost fatal disadvantage to recording materials. In order to obviate this disadvantage, there have been made such proposals that a coupler low in fading is used, a fading preventive agent for preventing fading due to light is used, and an ultraviolet absorbing agent for preventing the images from being deteriorated by ultraviolet light is used.

Among others, the image deterioration preventive effect by fading preventive agents is great, and as examples of such agents are known hydroquinones, hindered phenols, tocopherols, chromans, coumarans, compounds obtained by etherifying the phenolic hydroxyl group of these compounds (e.g., U.S. Pat. Nos. 3,935,016, 3,700,455, 3,764,337, 3,432,300, 3,573,050, and 4,254,216, British Pat. No. 2,066,975, etc.).

Although it is recognized that these compounds have an effect as an agent for preventing dye images from fading or discoloring, they are not satisfactory to meet the demand of customers who are now seeking high image quality, and cannot exhibit an excellent effect as a whole for color photography since they change the hue, or cause fogging, or cause defective dispersion.

On the other hand, the inventors found that compounds having a dibenzospiroindane structure exhibit an excellent effect for preventing images from being deteriorated and proposed their use for example in U.S. Pat. Nos. 4,360,589 and 4,416,978, British Pat. No. 2,135,788A, Japanese Patent Application (OPI) Nos. 204035/1982, 204037/1982 and 6652/1986.

However, techniques have progressively developed and accordingly demand for the stability of images have further increased. Thus, the above techniques are now unsatisfactory and further improvement is expected.

BRIEF SUMMARY OF THE INVENTION

An object of the present invention is to provide a color photographic material in which the color image obtained therefrom will not discolor for a long period of time, the yellow stain of the white background of the color image is suppressed remarkably and therefore the color image has high preservability.

A further object of the present invention is to provide a photographic fading preventive agent that will not cause a change of the hue or fogging, has an enough of an effect for preventing a color image from fading or discoloring, and will not form fine crystals after being applied.

Other and further objects, features and advantages of the invention will appear more fully from the following description.

DETAILED DESCRIPTION OF THE INVENTION

As a result of extensive research, the inventors have found that when at least one of the compounds having general formula (I) or (II) given below is contained in a photographic layer of a silver halide color photographic material, the objects of the present invention can be attained.

General formula (I)

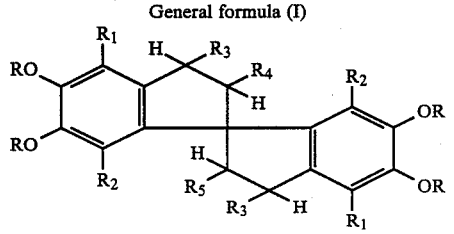

General formula (II)

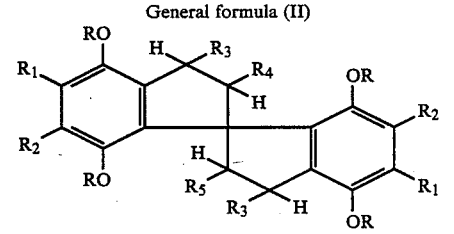

wherein R's each represents hydrogen an alkyl group (e.g., methyl, ethyl, propyl, n-octyl, tert-octyl, benzyl, hexadecyl, etc.), alkenyl group (e.g., allyl, octenyl, oleyl, etc.), aryl group (e.g., phenyl, naphthyl, etc.), heterocyclic ring group (e.g., tetrahydropyranyl, pyrimidyl, etc.), or a group represented by $R_6CO$, $R_7SO_2$ or $R_8NHCO$ in which $R_6$, $R_7$ and $R_8$ each represents an alkyl group (e.g. methyl, ethyl, n-propyl, n-butyl, n-octyl, tert-octyl, benzyl, etc.), alkenyl group (e.g., aryl, octenyl, oleyl, etc.), aryl group (e.g., phenyl, methoxyphenyl, naphthyl, etc.), or heterocyclic ring group (e.g., pyridyl, pyrimidyl, etc.); $R_1$ and $R_2$ each represents a hydrogen atom, halogen atom (e.g., fluorine, chlorine, bromine, etc.), alkyl group (e.g., methyl, ethyl, n-butyl, benzyl, etc.), alkenyl group (e.g., allyl, hexenyl, octenyl, etc.), alkoxy group (e.g., methoxy, ethoxy, benzyloxy, etc.), alkenoxy group (e.g., 2-propenyloxy, hexenyloxy, etc.), aryloxy group (e.g., phenyloxy, naphthyloxy, etc.), alkylthio group (e.g., ethylthio, butylthio, etc.), alkenylthio group (e.g., 2-butenylthio, 2-pentenylthio, etc.), arylthio group (e.g., phenylthio, naphthylthio, etc.), alkoxycarbonyl group (e.g., methoxycarbonyl, butoxycarbonyl, etc.), alkylcarbonyl group (e.g., acetyl, tetradecanoyl, etc.), hydroxy group, alkylcarbonyloxy group (e.g., acetyloxy, tetradecanoyloxy, etc.), carbamoyl group (e.g., N-ethylcarbamoyl, N-methyl-N-dodecylcarbamoyl, etc.), or acylamino group (e.g., acetylamino, benzoylamino); $R_3$ represents a hydrogen atom, alkyl group (e.g., methyl, ethyl, n-butyl, benzyl, etc.), alkenyl group (e.g., 2-propenyl, hexenyl, octenyl, etc.), or aryl group (e.g., phenyl, methoxyphenyl, chlorophenyl, naphthyl, etc.); and $R_4$ and $R_5$ each represents a hydrogen atom, alkyl group (e.g., methyl, ethyl, n-butyl, etc.), alkenyl group (e.g., allyl, octenyl, etc.), alkoxy group (e.g., methoxy, butoxy, etc.), alkenoxy group (e.g., 2-propenyloxy, hexenyloxy, etc.), aryloxy group (e.g., phenyloxy, naphthyloxy, etc.), alkylthio group (e.g., ethylthio, butylthio, etc.), alkenylthio group (e.g., 2-butenylthio, 2-pentenylthio, etc.) or arylthio group (e.g., phenylthio, naphthylthio, etc.).

Groups represented by R or $R_1$, $R_2$ and $R_3$ in two compounds or in a compound represented by general formula (i) or (II) may be the same or different.

In R, $R_1$ and $R_2$, adjacent groups may join to form a 5-membered or 6-membered ring.

In general formula (I) and (II), preferably R represents a hydrogen atom or an alkyl group having preferably 1~20 carbon atoms, and $R_3$, $R_4$ and $R_5$ each represents a hydrogen atom, an alkyl group having preferably 1~20 carbon atoms or an aryl group. Preferably $R_1$ and $R_2$ each represents a hydrogen atom, alkyl group having preferably 1~20 carbon atoms, alkoxy group having preferably 1~20 carbon atoms or hydroxy group.

The compounds represented by general formula (I) and (II) are different from known dibenzospiroindane compounds (see U.S. Pat. Nos. 4,360,589 and 4,416,978, etc.) in the manner of substitution of the substituent on the spiroindane ring.

When the compounds represented by general formula (I) or (II) according to the present invention are used in combination with a known fading preventive agent, that is, a hydroquinone derivative, hydroxychroman derivative, hydroxyspirochroman derivative, hydroxychroman derivative wherein the hydroxyl group of hydroxyspirochroman is replaced by an alkoxy group, or alkoxyphenol derivative, the effect is further enhanced.

Although the amount of the dye stabilizers represented by general formula (I) or (II) used in the present invention depends on the type of coupler, generally it is suitable that the amount is in the range of from 0.5 to 200 wt. %, preferably from 2 to 150 wt. % based on the coupler.

Typical examples of these compounds are given below, which does not intend to limit the present invention.

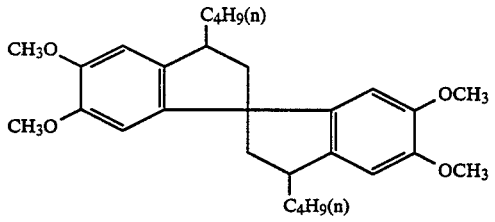

(1)

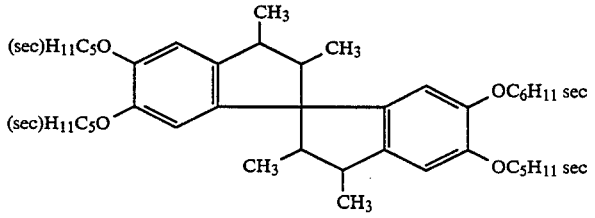

(2)

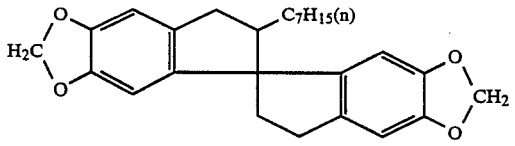

(3)

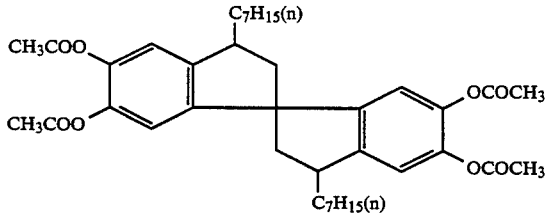

(4)

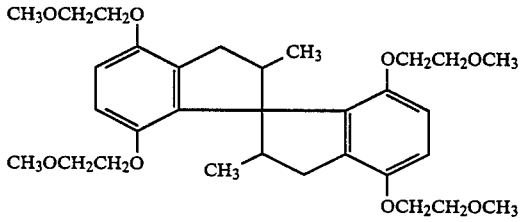

(5)

-continued
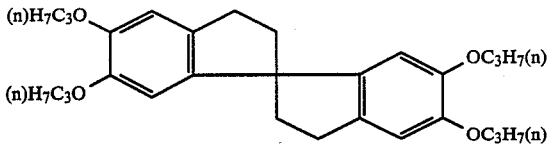
(6)
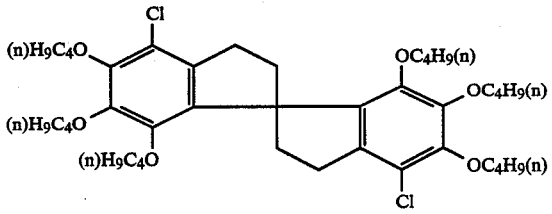
(7)
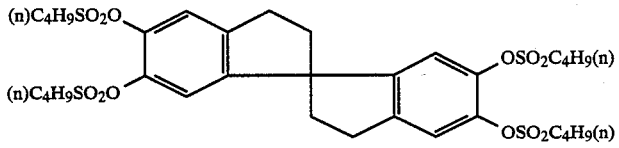
(8)
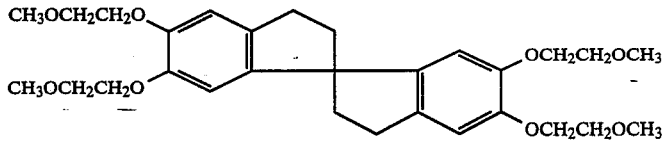
(9)
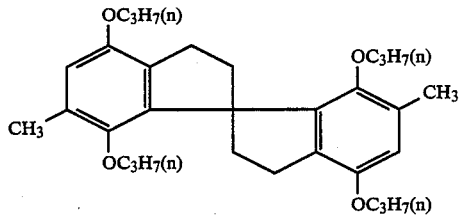
(10)
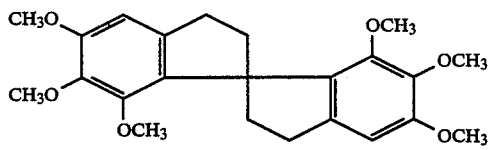
(11)
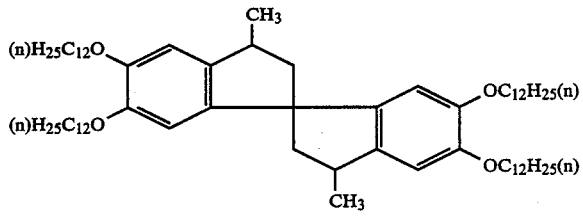
(12)

-continued
(13)
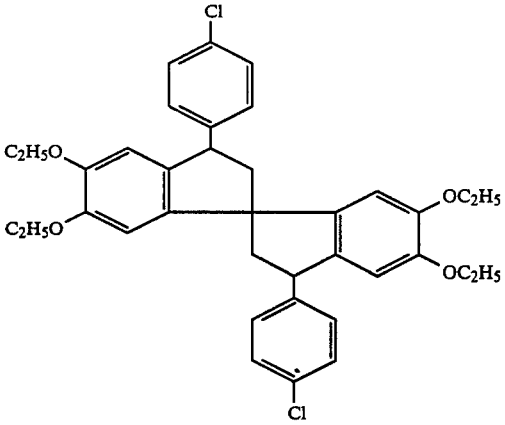
(14)
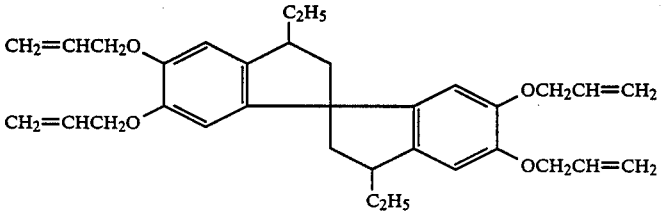
(15)
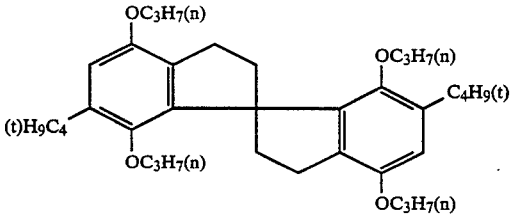
(16)
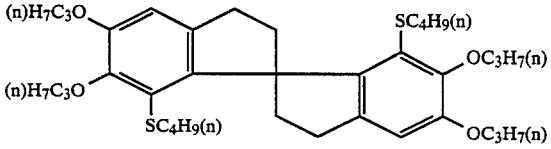
(17)
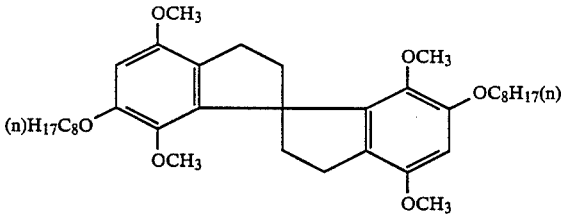
(18)
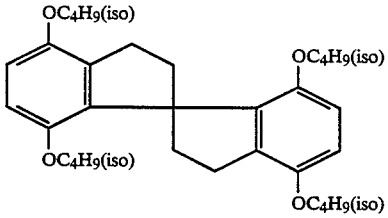
(19)
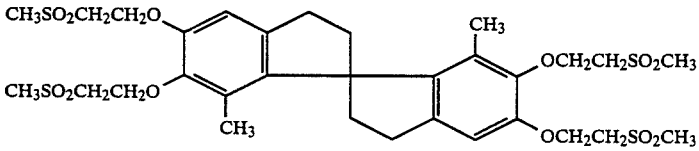

-continued
(20)
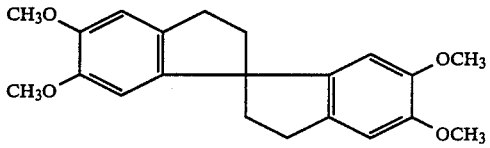
(21)
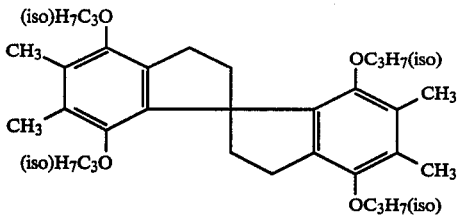
(22)
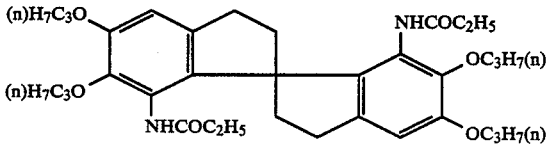
(23)
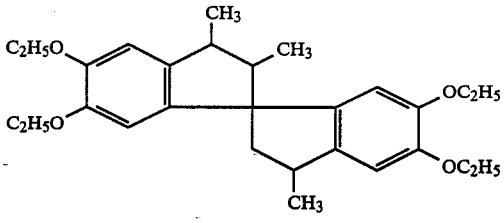
(24)
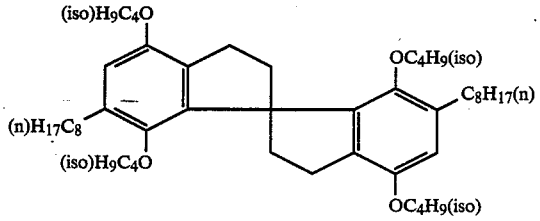
(25)
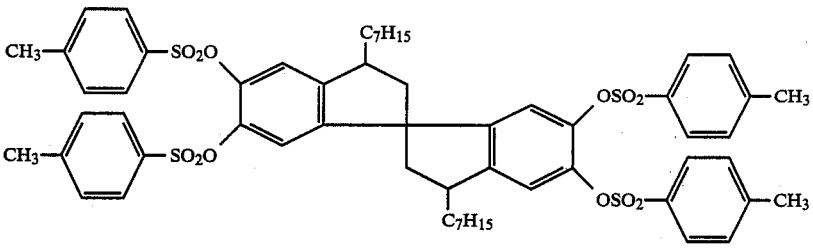
(26)
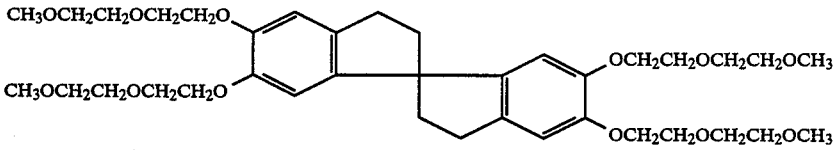
(27)
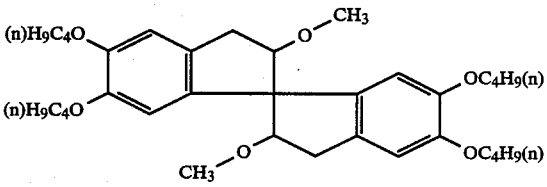
1,1'-spirobisindane compounds used in the present invention can be synthesized according to the methods Synthesis Examples of specific compounds are given below, but other compounds can also be synthesized in a similar manner.

Synthesis Example 1

Synthesis of 5,6,5',6'-tetrapropyloxy-1,1'-spirobisindane (Compound No. 6)

Synthesis of bis-(3,4-dipropyloxybenzal)acetone 22.2 g (0.1 mol) of 3,4-dipropyloxybenzaldehyde were dissolved in 160 ml of ethanol, 3 g (0.051 mol) of acetone were added thereto and the mixture was stirred at 25° to 30° C. 10.5 ml of solution of sodium methoxide (28% in methanol, 0.052 mol) were added dropwise to it over 30 min. It was stirred for a further 2 hours, and the deposited crystals were filtered and washed with 50 mol of cold ethanol to produce 20.5 of yellow crystals (yield: 92.4%).

Synthesis of bis-(3,4-dipropyloxybenzyl)acetone 20.5 g (0.044 mol) of bis-(3,4-dipropyloxybenzal)acetone were dissolved in 100 ml of methanol, 1 g of palladium/carbon was added thereto, and the mixture was hydrogenated in an autoclave at 25° to 30° C. under a hydrogen gas pressure. After the palladium/carbon was filtered off, the filtrate was condensed to deposit crystals followed by filtering to obtain 15.9 g of white crystals (yield: 77%).

Synthesis of 5,6,5',6'-tetrapropyloxy-1,1'-spirobisindane 100 ml of benzene and 62 ml of phosphorus oxychloride were added to 15.9 g (0.034 mol) of bis-(3,4-propyloxybenzyl)acetone, and the mixture was heated for 1 hour under reflux. After the benzene and excess phosphorus oxychloride were distilled off under vacuum, the reaction product was poured into 300 ml of ice water, and was extracted with 200 ml of ethyl acetate. The extract was washed twice with 20 ml of cold water and dried over anhydrous sodium sulfate. After the anhydrous sodium sulfate was filtered off, the ethyl acetate was distilled off under vacuum, and the obtained oil was refined by column chromatography to produce 13 of 5,6,5',6'-tetrapropyloxy-1,1'-spirobisindane in the form of an oil (yield: 85%).

Analysis: Found: C 77.03%; H 8.92% Calculated: C 76.95%; H 8.91%

Synthesis Example 2

Synthesis of 5,6,5',6'-tetrabutanesulfonyloxy-1,1'-spirobisindane (Compound No. 8)

5 g (0.011 mol) of 5,6,5',6'-tetrahydroxy-1,1'-spirobisindane were dissolved in 100 ml of methylene chloride, and the mixture was stirred at 0° to 5° C. 11 g (0.044 mol) of boron tribromide were added to the resulting solution over 30 min. The reaction mixture was poured into 300 ml of ice water and was extracted with methylene chloride. The extract was washed with 100 ml of cold water, and the methylene chloride layer was condensed to dryness to obtain 2.8 g of a white solid (yield: 90%).

Synthesis of 5,6,5',6'-tetrabutanesulfonyloxy-1,1'-spirobisindane 2.8 g (0.01 mol) of 5,6,5',6'-tetrahydroxy-1,1'-spiroindane were dissolved in 50 ml of dimethylacetamide, and the mixture was stirred at 15° to 20° C. under a flow of nitrogen. 6.2 ml (0.044 mol) of triethylamine were added to the solution, and 6.9 g (0.04 mol) of butanesulfonyl chloride were added dropwise thereto over 30 min. After stirring for a further 30 min, 300 ml of ice water were added thereto and it was extracted with 150 ml of ethyl acetate. After the extract was washed twice with 150 ml of cold water, the extract was dried over anhydrous sodium sulfate. After the anhydrous sodium sulfate was filtered off, the ethyl acetate was distilled off, and the resulting oil was refined by column chromatography thereby producing 5.9 g of 5,6,5',6'-tetrabutanesulfonyloxy-1,1'-spiroindane in the form of an oil (yield: 77%).

Analysis: Found: C 51.75%; H 6.29% Calculated: C 51.81%; H 6.32%

The compounds represented by general formula (I) or (II) according to the present invention may be used in combination with yellow couplers, magenta couplers or cyan couplers.

These couplers that are used in combination with the compounds represented by general formula (I) or (II) may be 2-equivalent or 4-equivalent to a silver ion, and may be in the form of a polymer or oligomer. Further, these couplers can be used alone or in combination.

The general formulas of preferable couplers used in the present invention are given below.

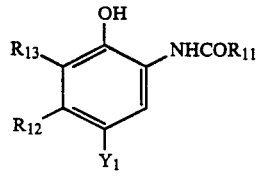

General formula (III)

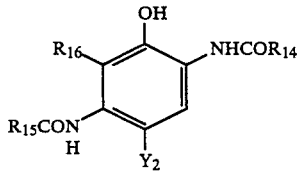

General formula (IV)

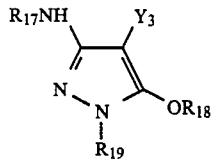

General formula (V)

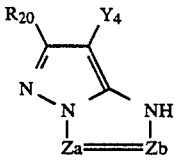

General formula (VI)

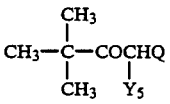

General formula (VII)

wherein $R_{11}$, $R_{14}$ and $R_{15}$ each represents an aliphatic group, aromatic group, heterocyclic group, aromatic amino group, or heterocyclic amino group; $R_{12}$ represents an aliphatic group; $R_{13}$ and $R_{16}$ each represents a hydrogen atom, halogen atom, aliphatic group, aliphatic oxy group or acylamino group; $R_{17}$ and $R_{19}$ each represents a substituted or unsubstituted phenyl group; $R_{18}$ represents a hydrogen atom, aliphatic or aromatic acyl group, or aliphatic or aromatic sulfonyl group; $R_{20}$ represents a hydrogen atom or a substituent; Q represents a substituted or unsubstituted N-phenylcarbamoyl group; Za and Zb each represents a methine group, substituted methine group or =N—; and $Y_1$, $Y_2$, $Y_3$, $Y_4$ and $Y_5$ each represents a group capable of splitting off at the time of coupling reaction with the oxidation product of a developing agent (hereinafter referred to as a coupling split-off group).

In general formulas(III) and (IV), $R_{12}$ and $R_{13}$, and $R_{15}$ and $R_{16}$ respectively may form a 5-membered, 6-membered or 7-membered ring.

Further, dimers or more higher polymers may be formed through $R_{11}$, $R_{12}$, $R_{13}$ or $Y_1$; $R_{14}$, $R_{15}$, $R_{16}$ or $Y_2$; $R_{17}$, $R_{18}$, $R_{19}$ or $Y_3$; $R_{20}$, Za, Zb or $Y_4$; Q or $Y_5$.

The aliphatic groups mentioned above represent linear, branched or cyclic alkyl, alkenyl or alkinyl groups.

Preferable examples of the couplers represented by general formulas(III) and (IV) are enumerated below.

(C-1)

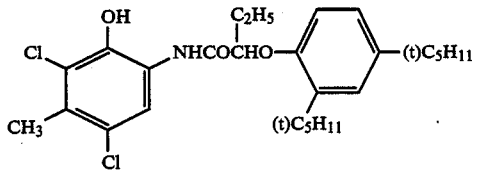

(C-2)

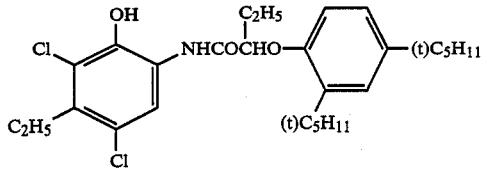

(C-3)

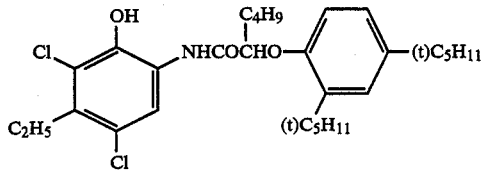

(C-4)

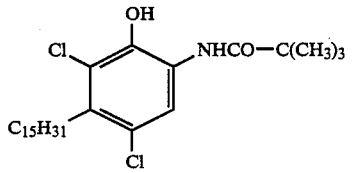

(C-5)

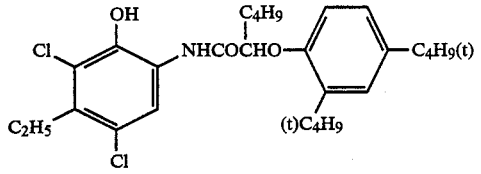

(C-6)

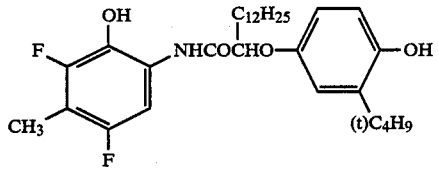

(C-7)

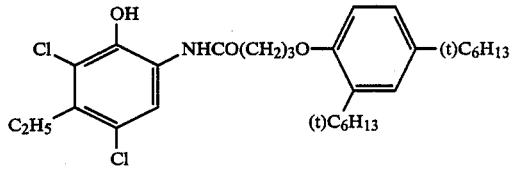

-continued
(C-8)
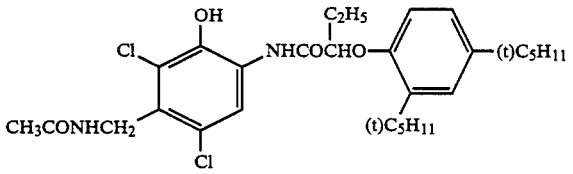
(C-9)
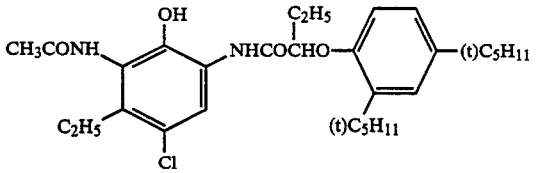
(C-10)
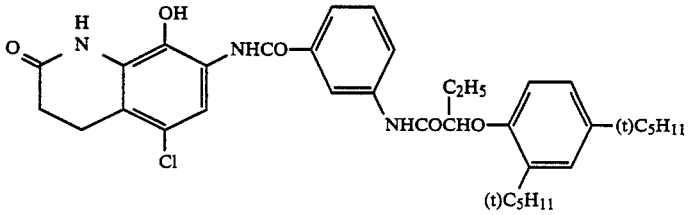
(C-11)
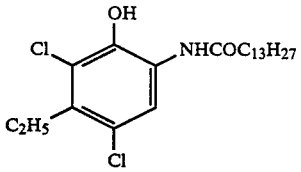
(C-12)
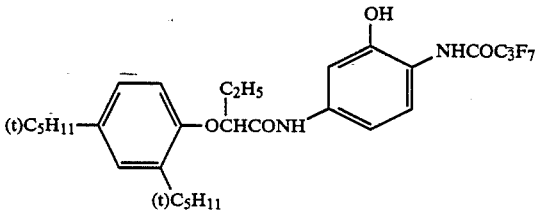
(C-13)
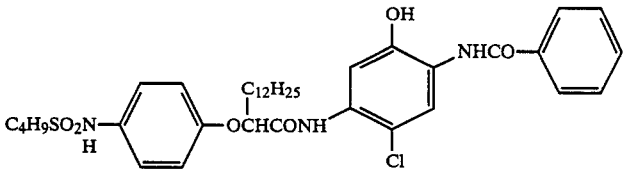
(C-14)
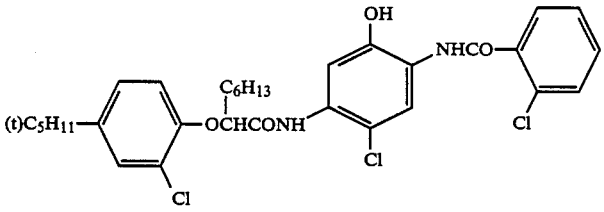
(C-15)
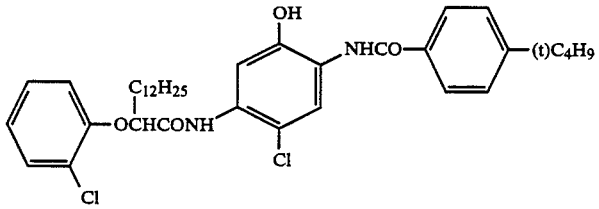

-continued
(C-16)
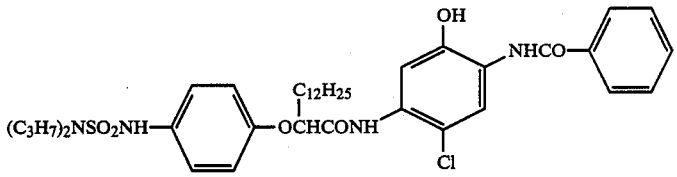
(C-17)
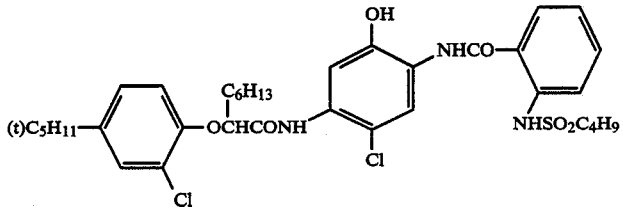
(C-18)
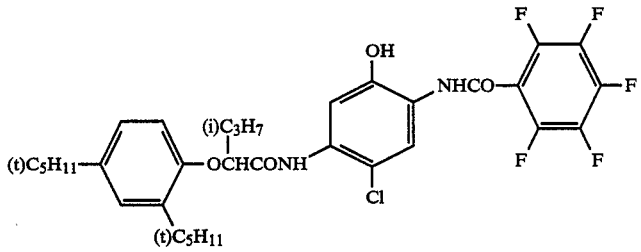
(C-19)
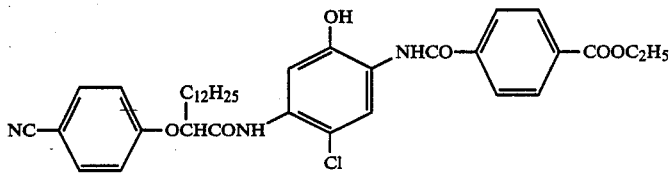
(C-20)
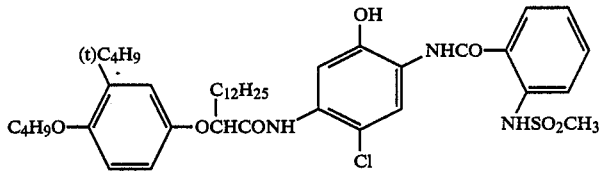
(C-21)
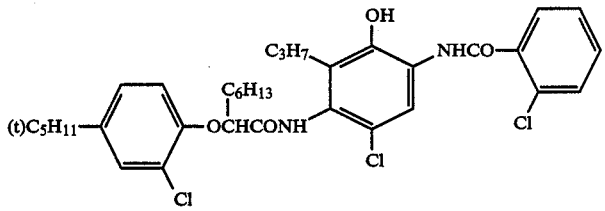
(C-22)
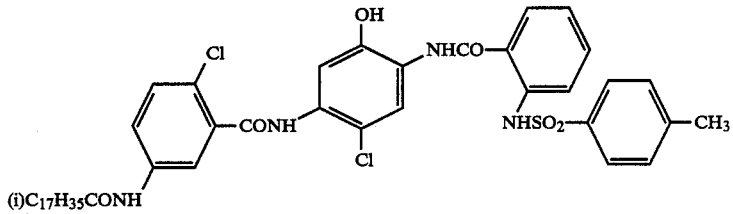

-continued
(C-23)
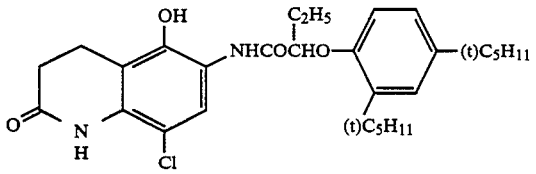
(C-24)
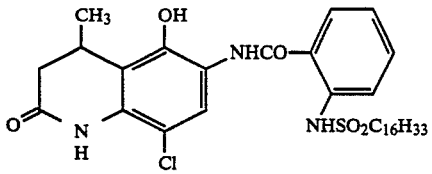
(C-25)
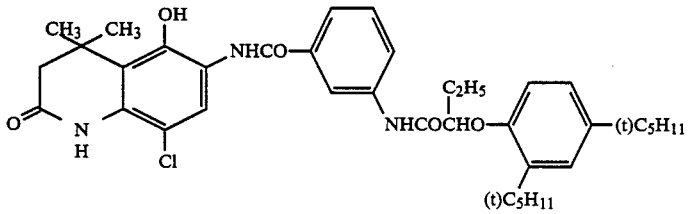
(C-26)
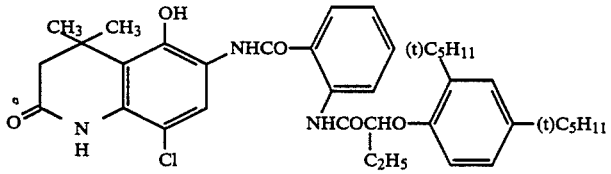
(C-27)
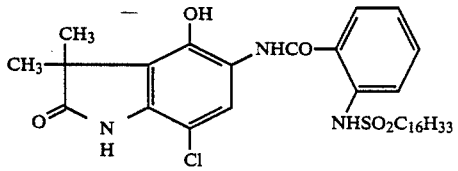
(C-28)
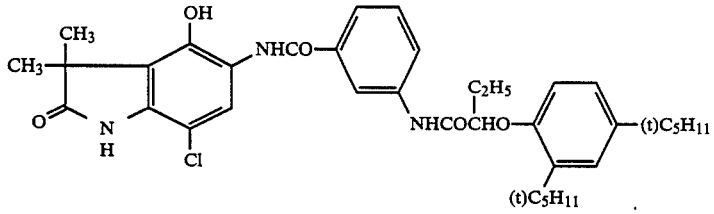
(C-29)
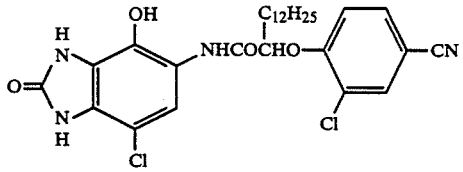
(C-30)
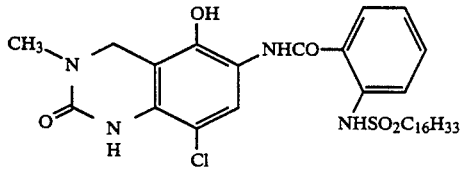

-continued
(C-31)
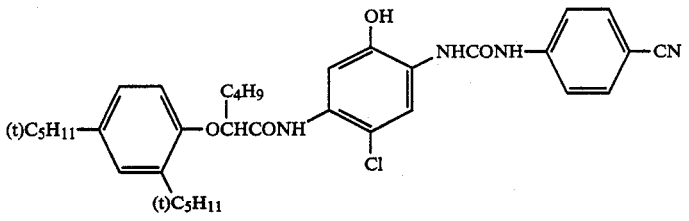
(C-32)
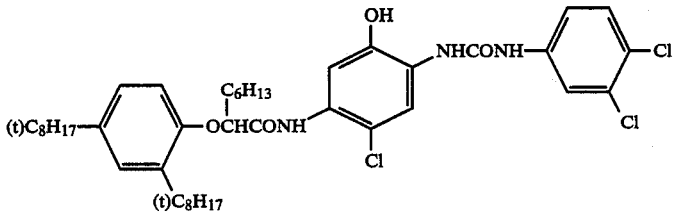
(C-33)
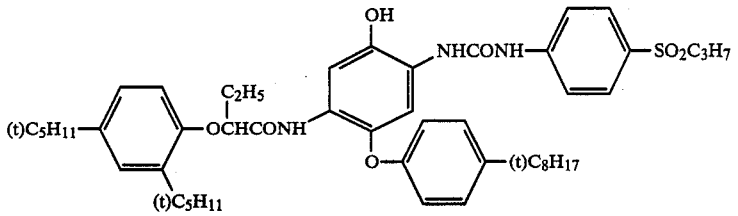
(C-34)
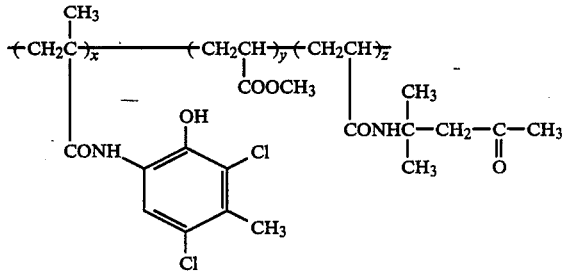
x/y/z = 50/20/30 (weight ratio)
(C-35)
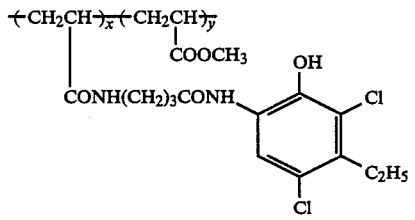
x/y = 55/45 (weight ratio)
(C-36)
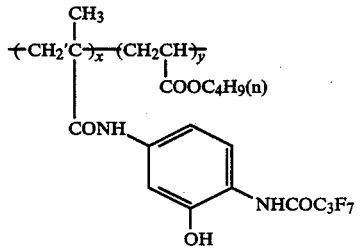
x/y = 60/40 (weight ratio)

-continued
(C-37)
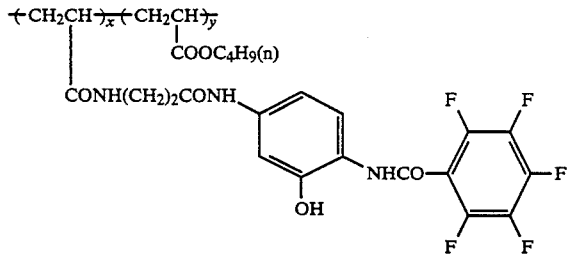
x/y = 50/50 (weight ratio)
(C-38)
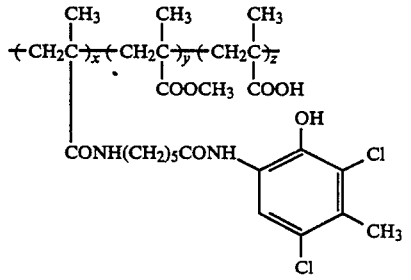
x/y/z = 55/40/5 (weight ratio)
(C-39)
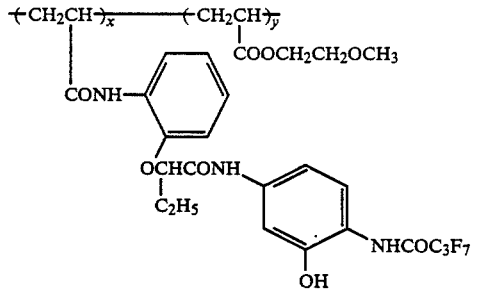
x/y = 60/40 (weight ratio)
(C-40)
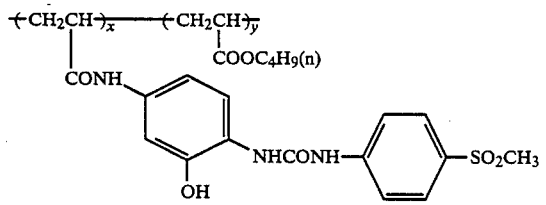
x/y = 50/50 (weight ratio)
(C-41)
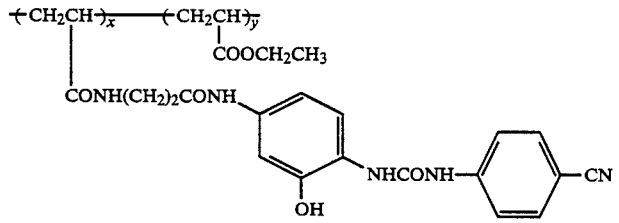
x/y = 45/55 (weight ratio)
(C-42)
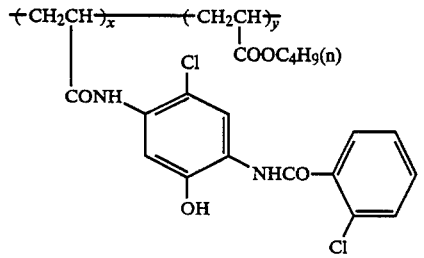
x/y = 50/50 (weight ratio)

-continued
(C-43)
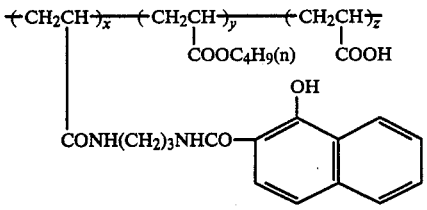
x/y/z = 45/45/10 (weight ratio)
(C-44)
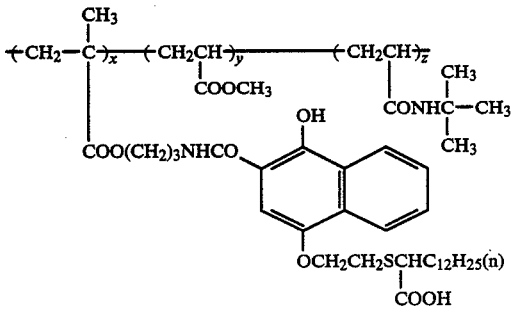
x/y/z = 50/20/30 (weight ratio)
(C-45)
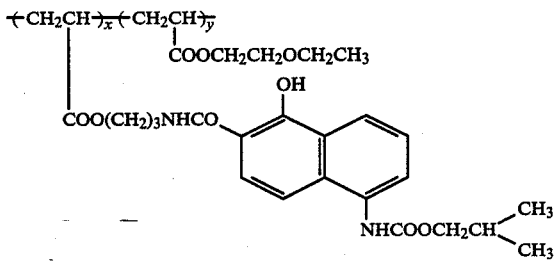
x/y = 50/50 (weight ratio)
(C-46)
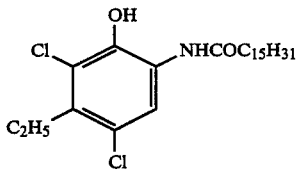
(C-47)
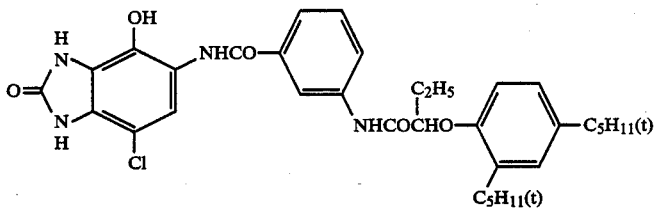
(C-48)
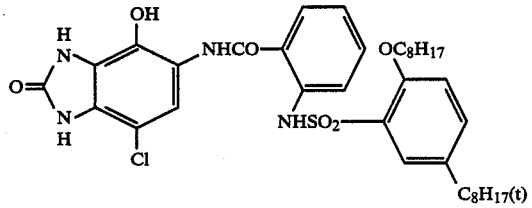

-continued
(C-49)
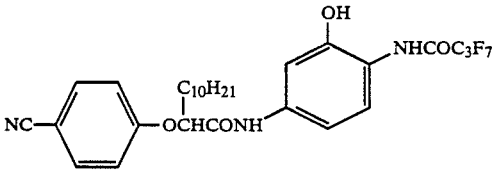
Preferable examples of the couplers represented by general formulas (V) and (VI) are enumerated below.
(M-1)
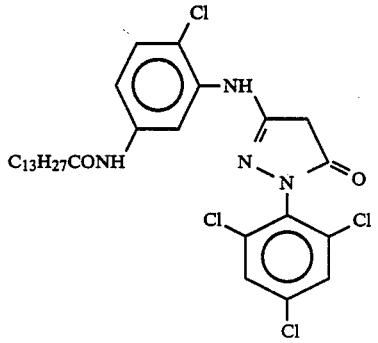
(M-2)
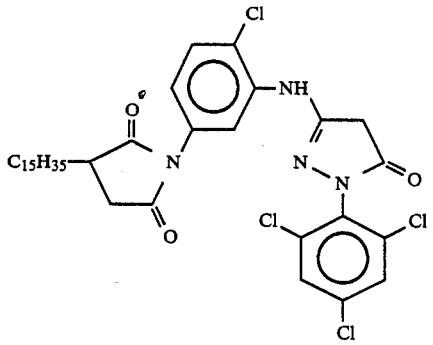
(M-3)
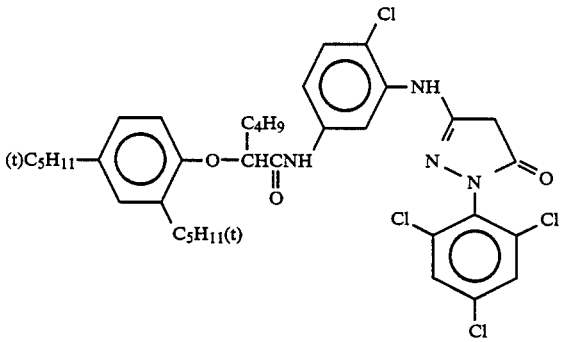
(M-4)
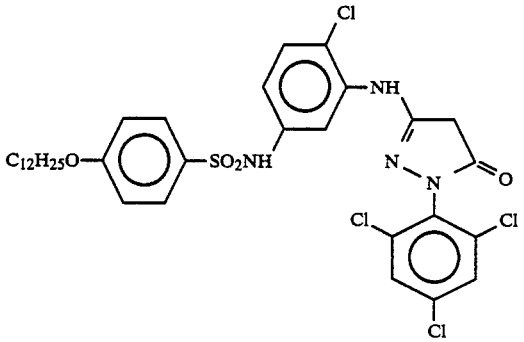

-continued
(M-5)
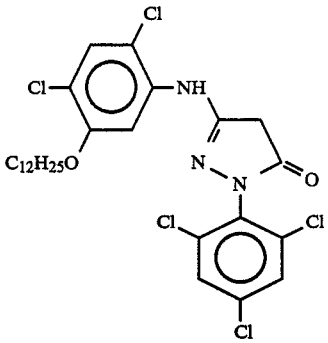
(M-6)
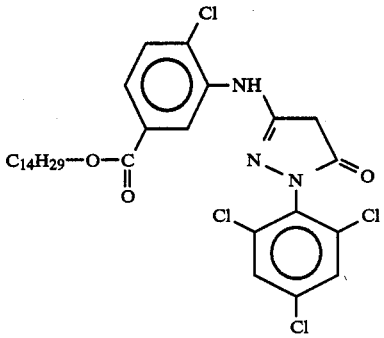
(M-7)
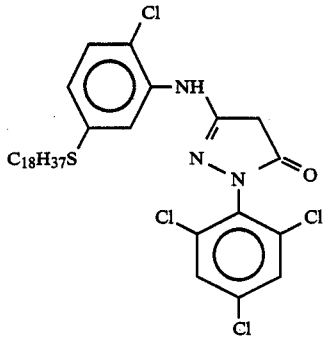
(M-8)
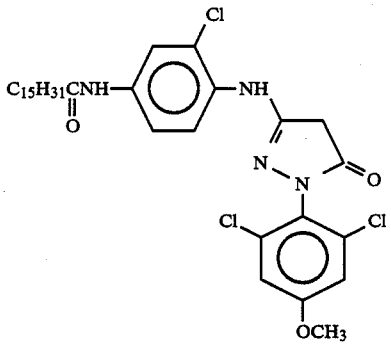
(M-9)
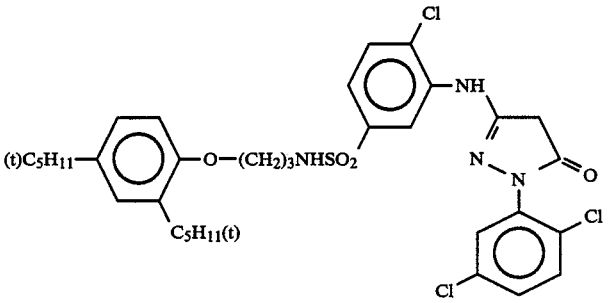

-continued
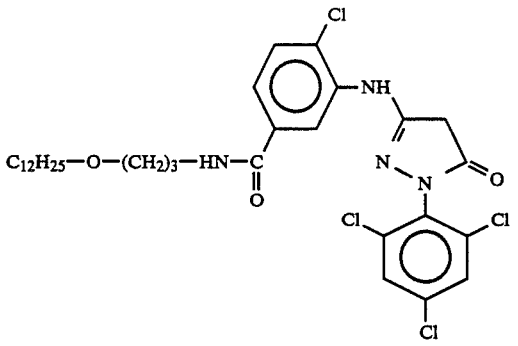
(M-10)
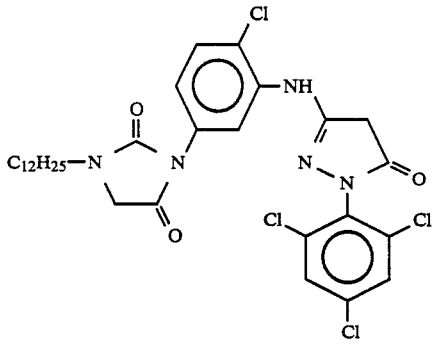
(M-11)
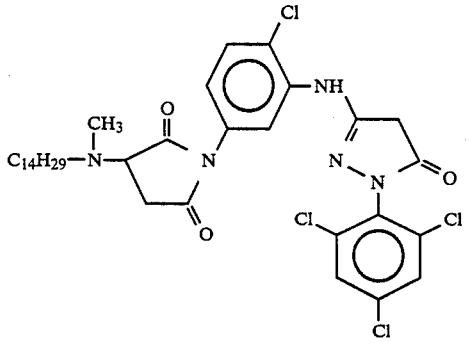
(M-12)
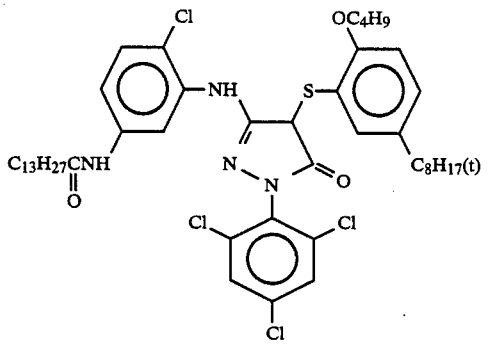
(M-13)

-continued
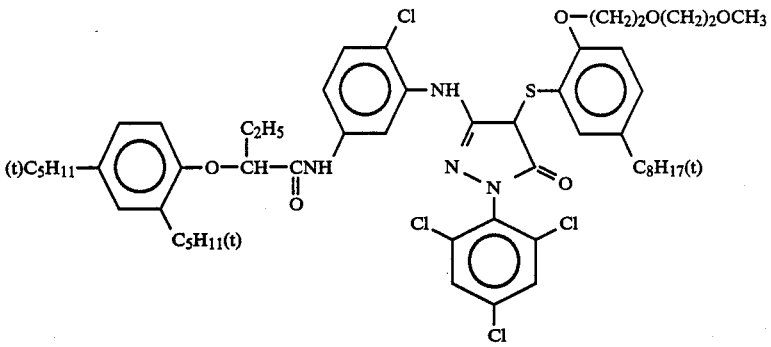
(M-14)
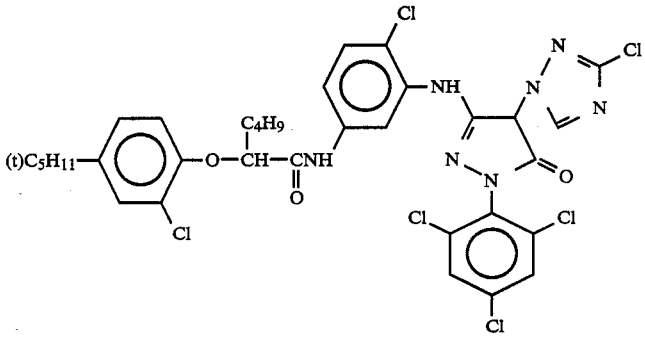
(M-15)
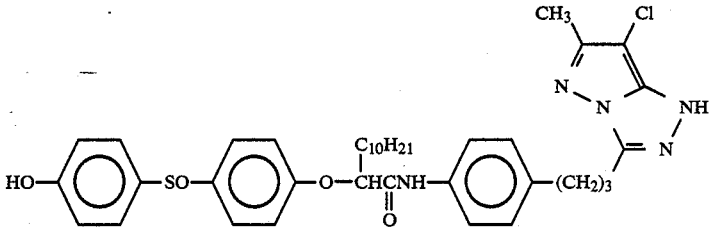
(M-16)
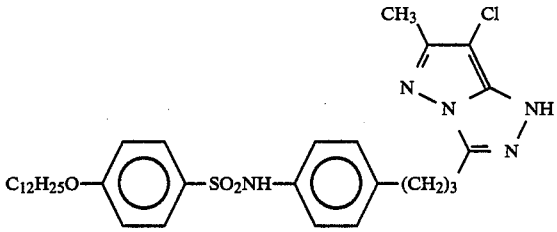
(M-17)
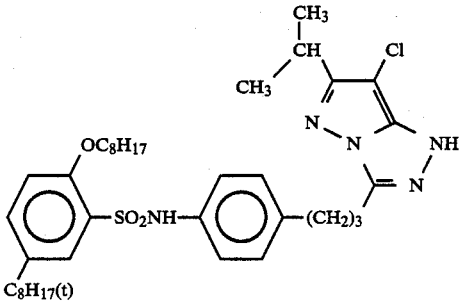
(M-18)

-continued
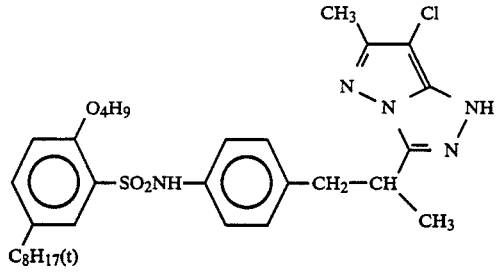
, (M-19)
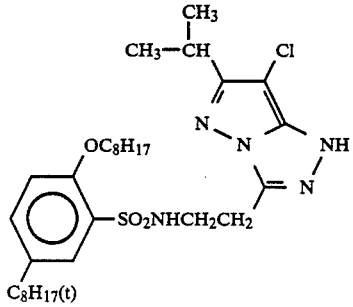
(M-20)
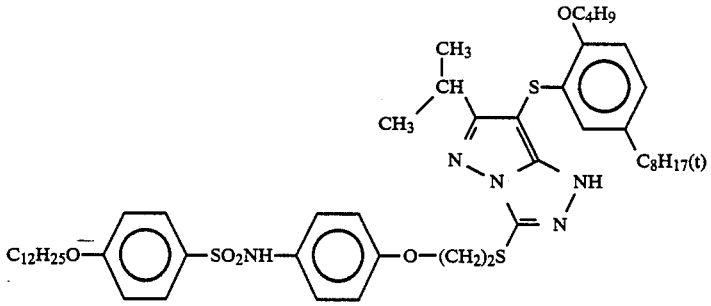
(M-21)
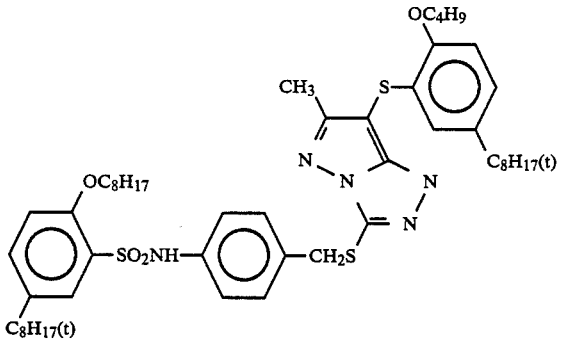
(M-22)
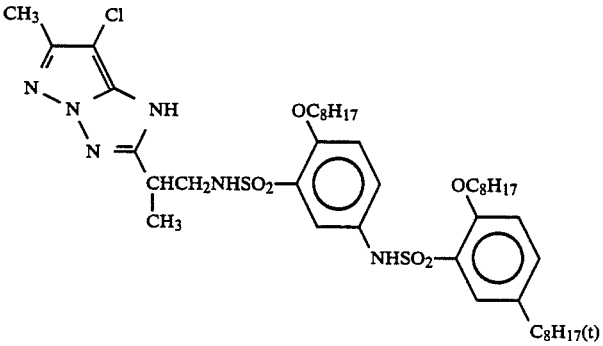
(M-23)

-continued
(M-24)
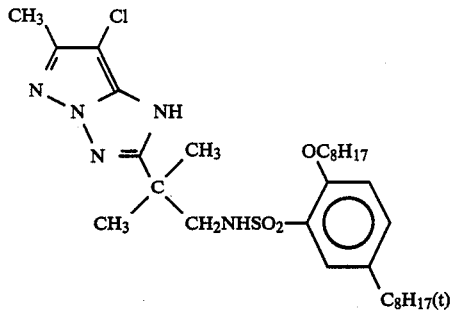
(M-25)
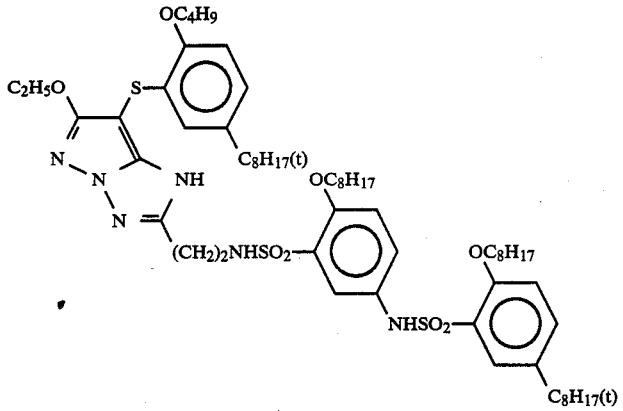
(M-26)
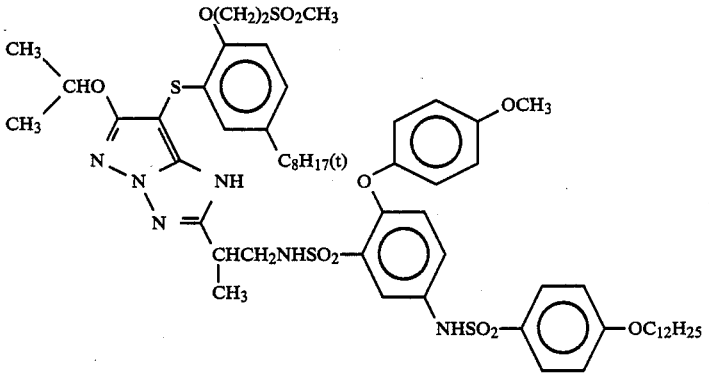
(M-27)
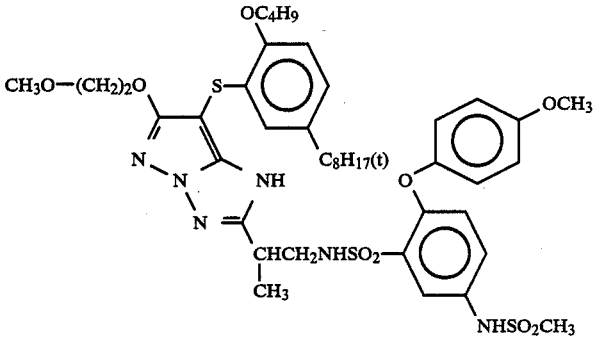

-continued
(M-28)
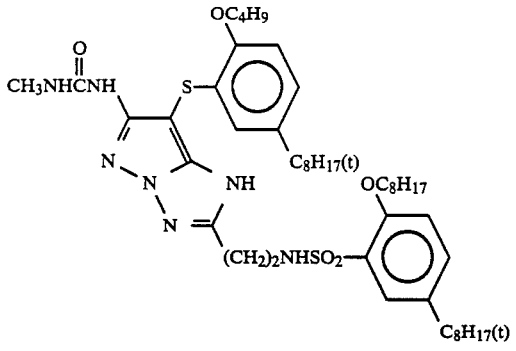
(M-29)
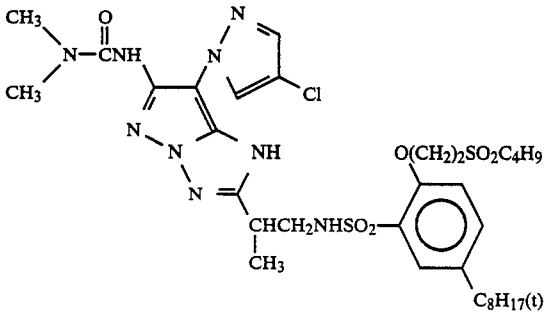
(M-30)
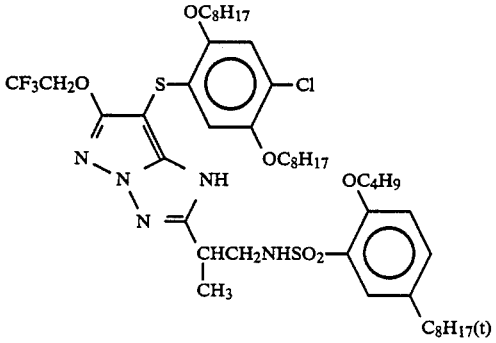
(M-31)
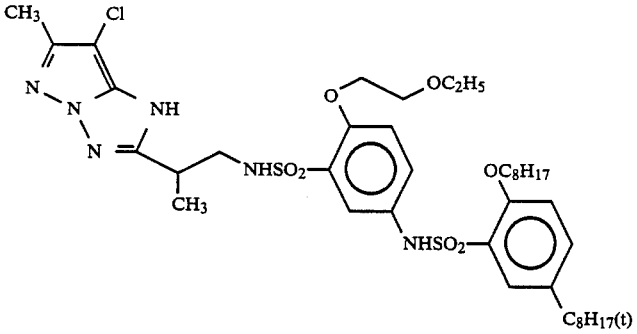
(M-32)
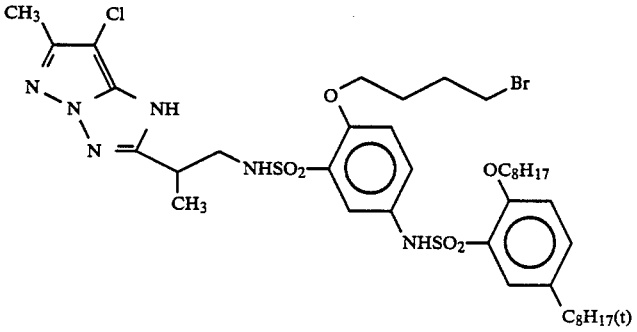

-continued
(M-33)
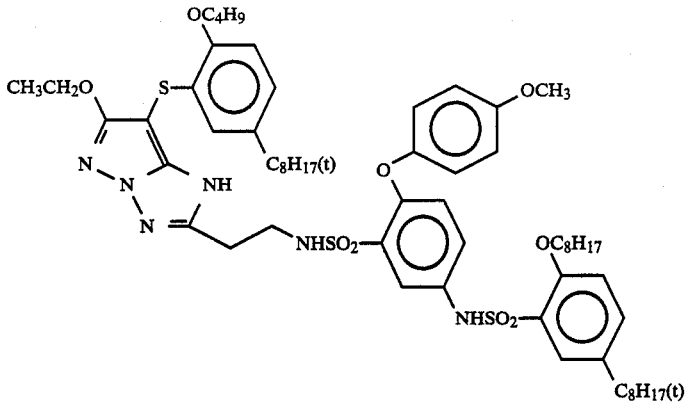
(M-34)
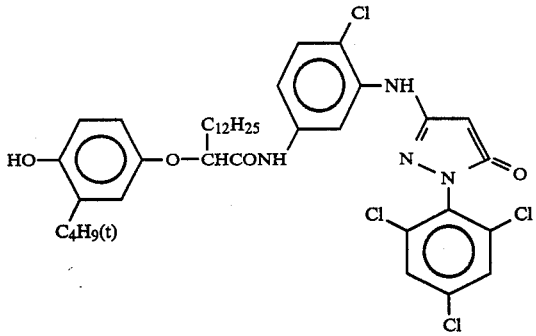
(M-35)
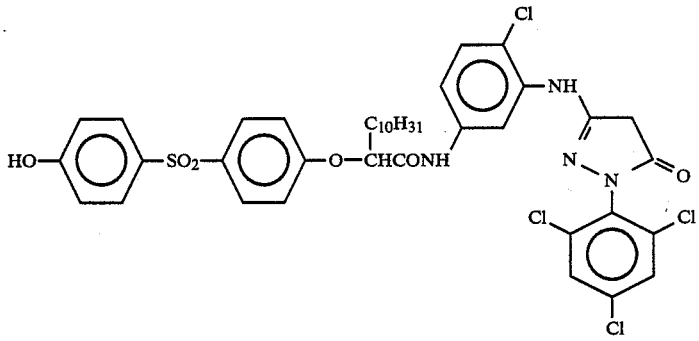
(M-36)
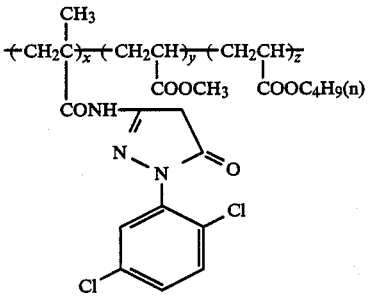
x/y/z = 50/25/25 (weight ratio)

-continued
(M-37)
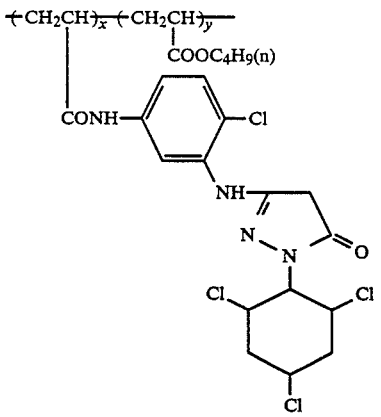
x/y = 50/50 (weight ratio)
(M-38)
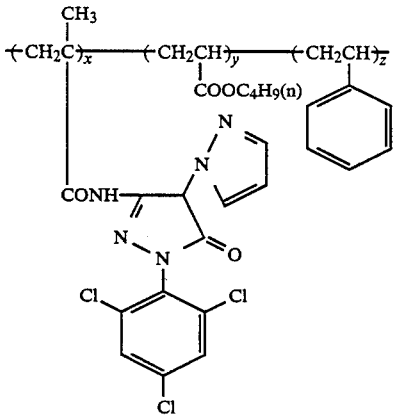
x/y/z = 50/25/25 (weight ratio)
(M-39)
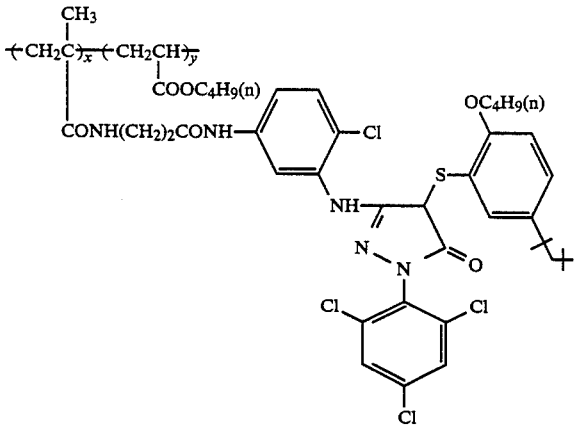
x/y = 50/50 (weight ratio)

-continued
(M-40)
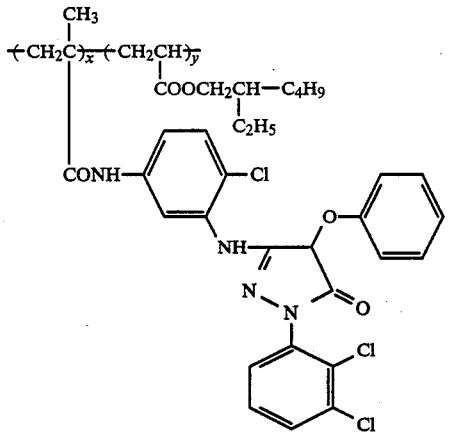
x/y = 40/60 (weight ratio)
(M-41)
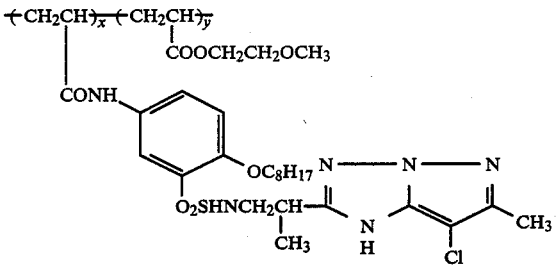
x/y = 45/55 (weight ratio)
(M-42)
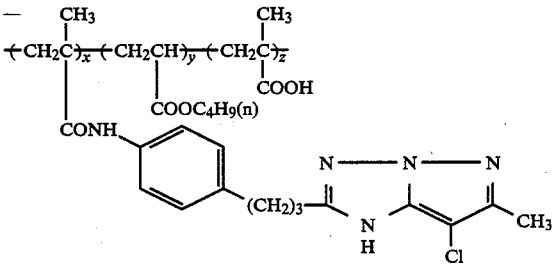
x/y/z = 50/45/5 (weight ratio)
(M-43)
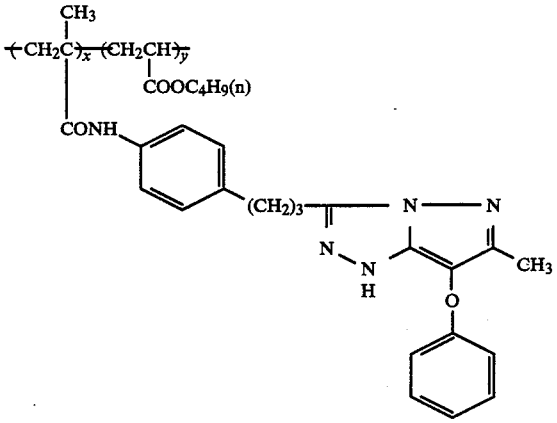
x/y = 50/50 (weight ratio)

-continued
(M-44)
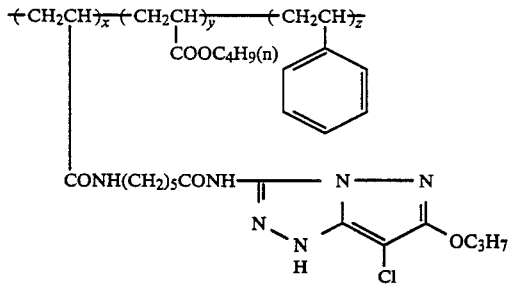
x/y/z = 45/50/5 (weight ratio)
(M-45)
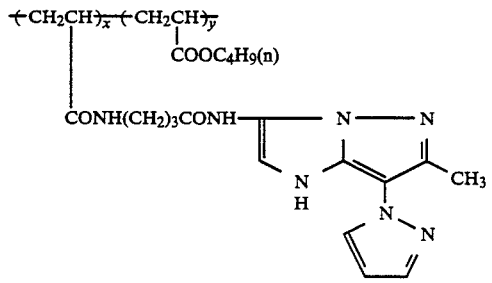
x/y = 50/50 (weight ratio)
(M-46)
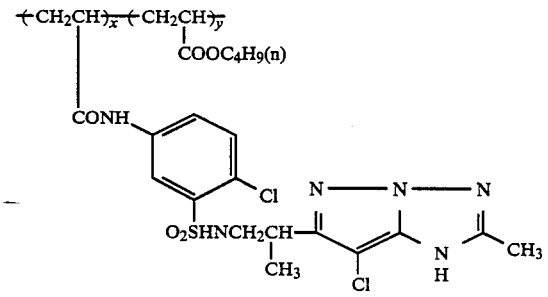
x/y = 50/50 (weight ratio)
(M-47)
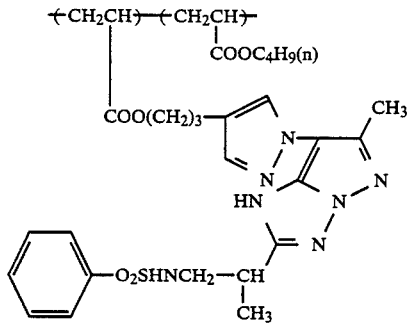
x/y = 45/55 (weight ratio)
(M-48)
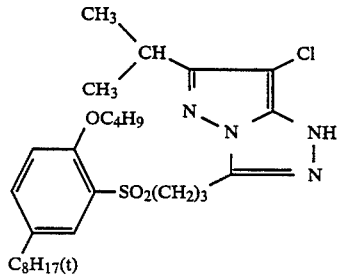

-continued
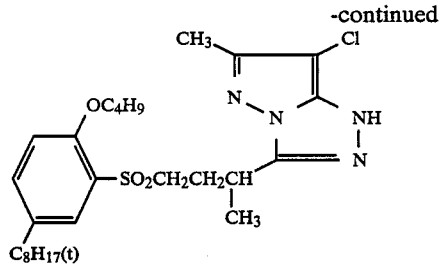
(M-49)
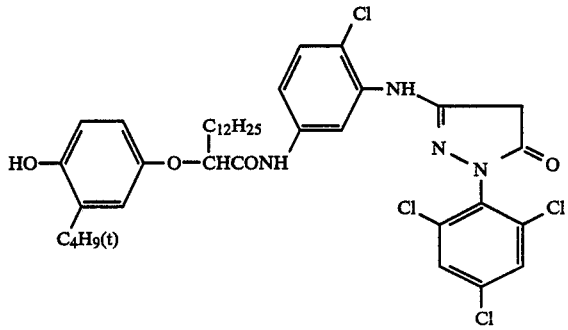
(M-50)
Preferable examples of the couplers represented by general formula (VII) is enumerated below.
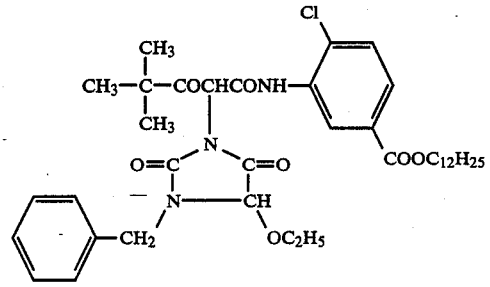
(Y-1)
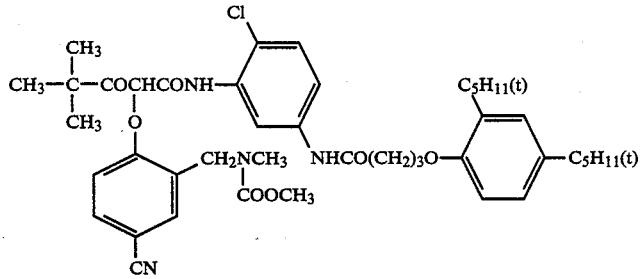
(Y-2)
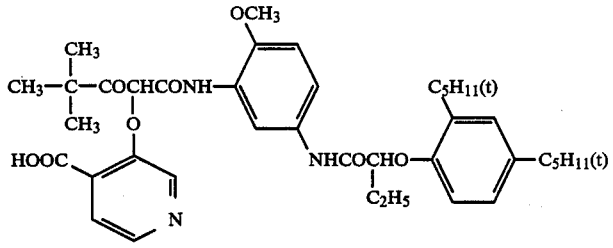
(Y-3)

-continued
(Y-4)
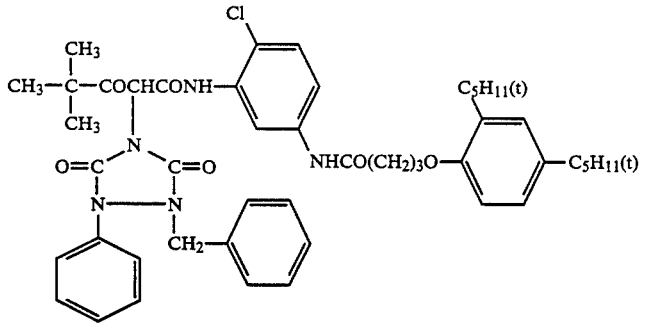
(Y-5)
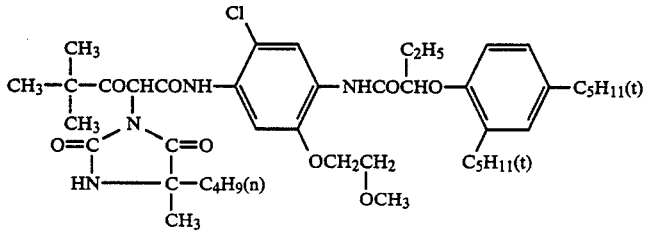
(Y-6)
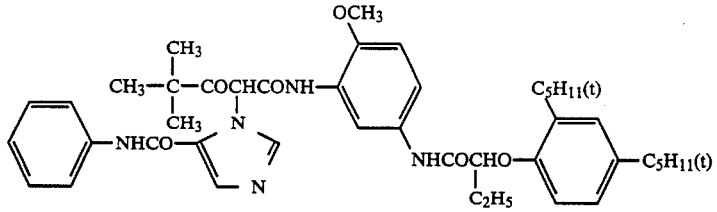
(Y-7)
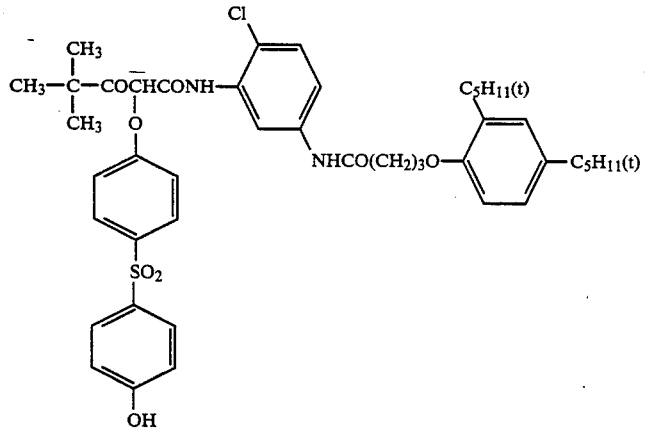
(Y-8)
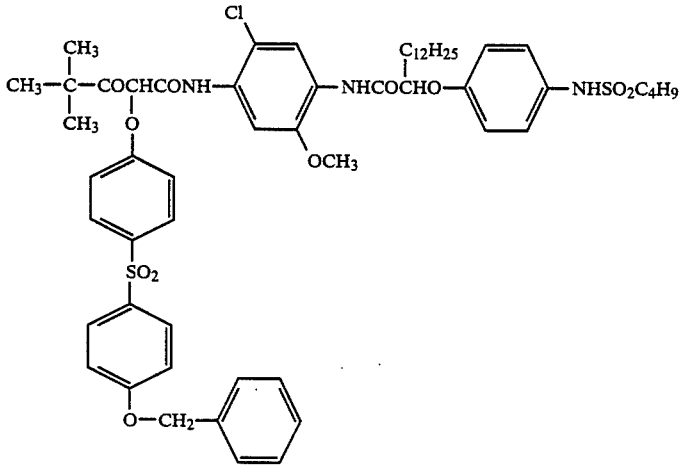

-continued
(Y-9)
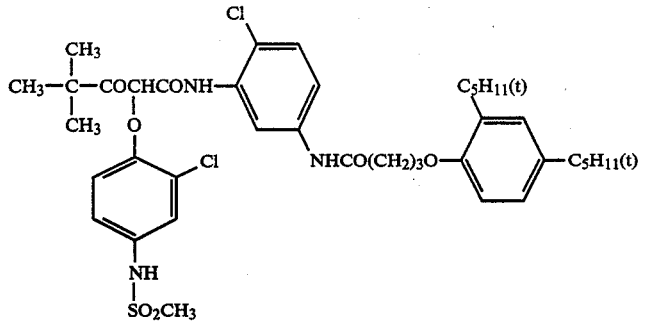
(Y-10)
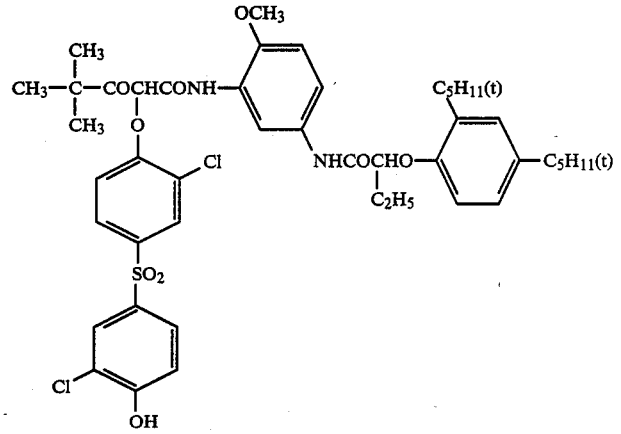
(Y-11)
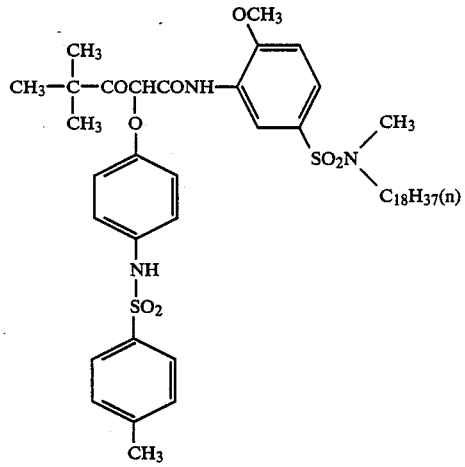
(Y-12)
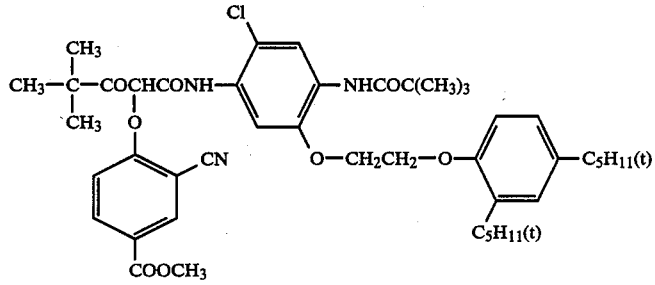

-continued
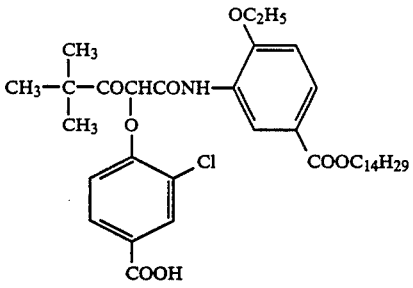
(Y-13)
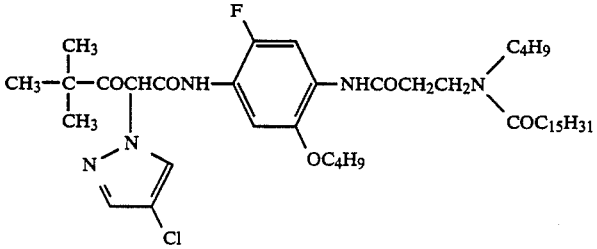
(Y-14)
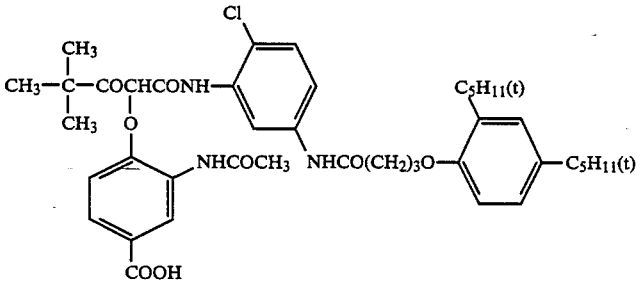
(Y-15)
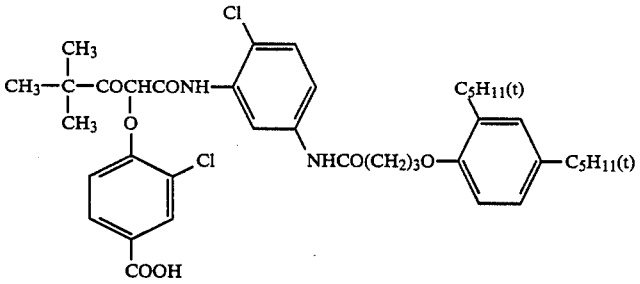
(Y-16)
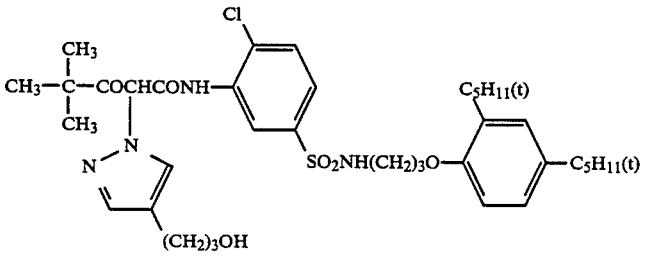
(Y-17)

-continued
(Y-18)
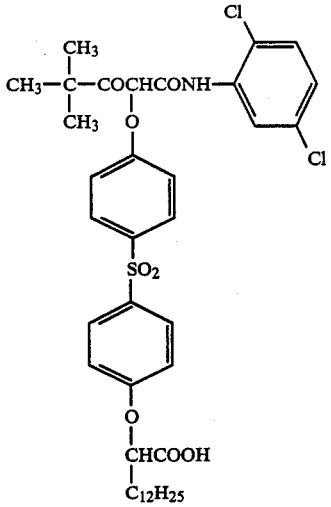
(Y-19)
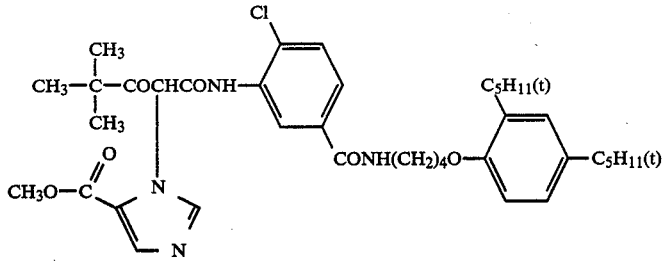
(Y-20)
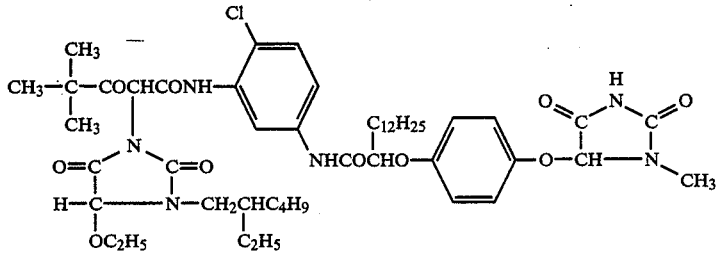
(Y-21)
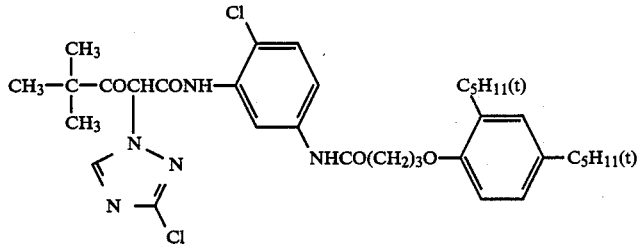
(Y-22)
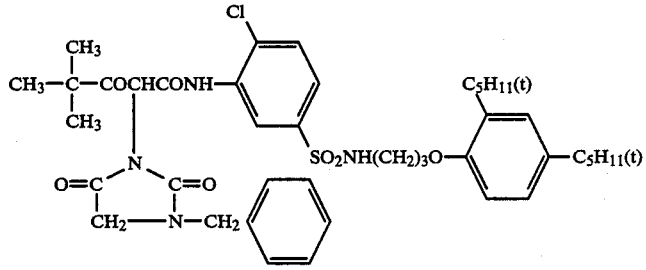

-continued
(Y-23)
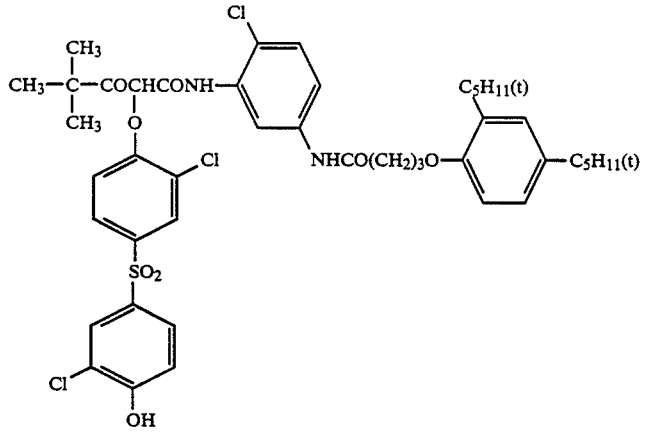
(Y-24)
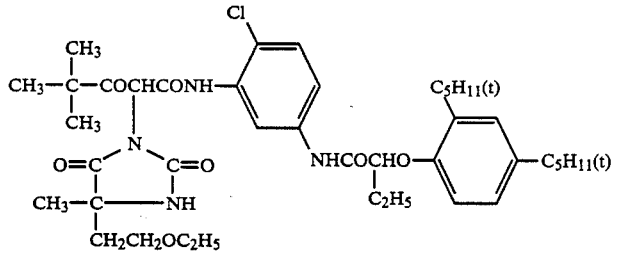
(Y-25)
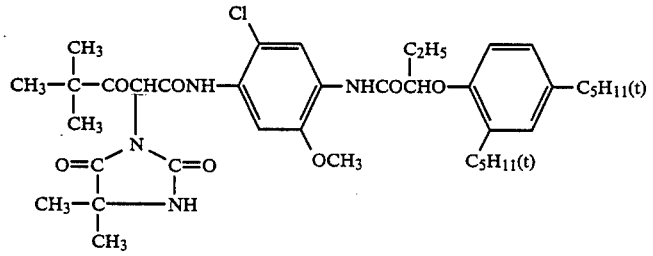
(Y-26)
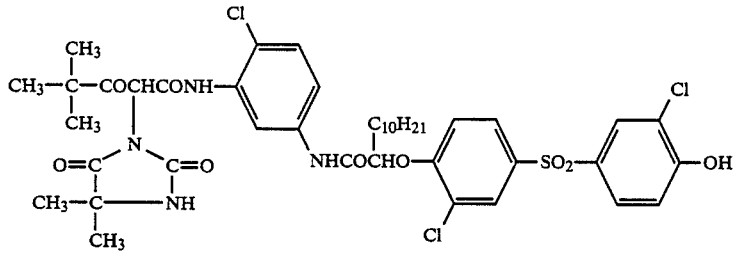
(Y-27)
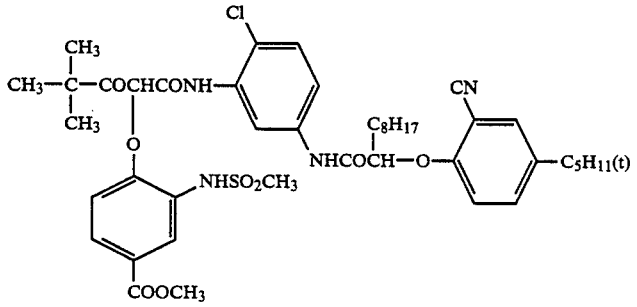

-continued
(Y-28)
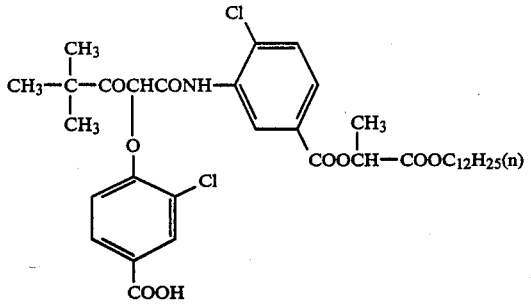
(Y-29)
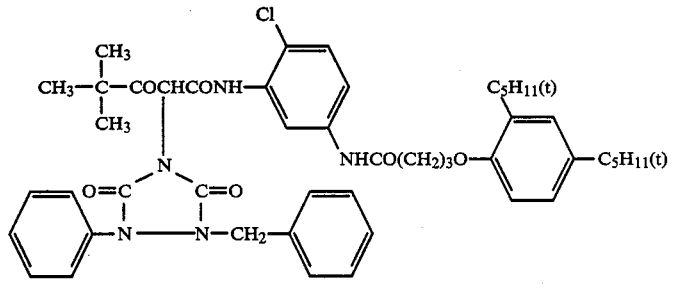
(Y-30)
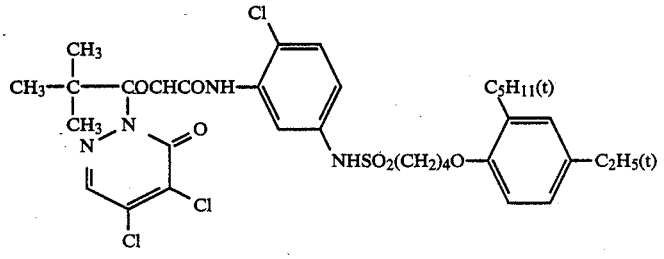
(Y-31)
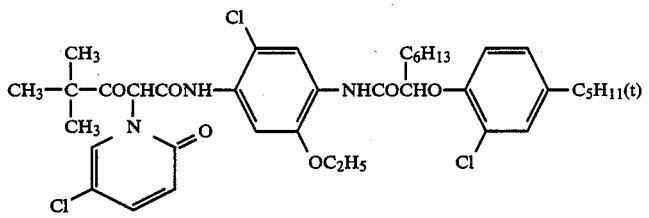
(Y-32)
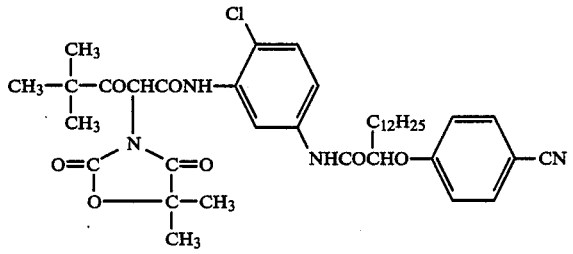

-continued
(Y-33)
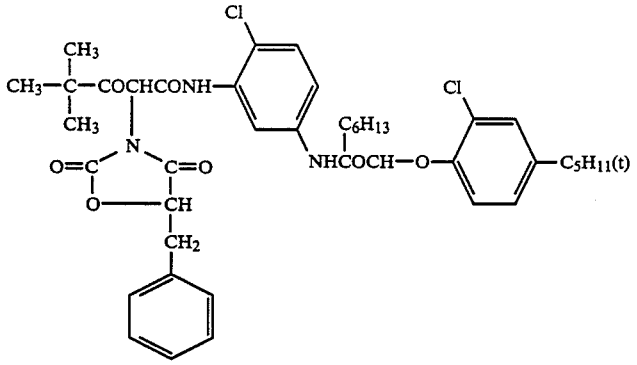
(Y-34)
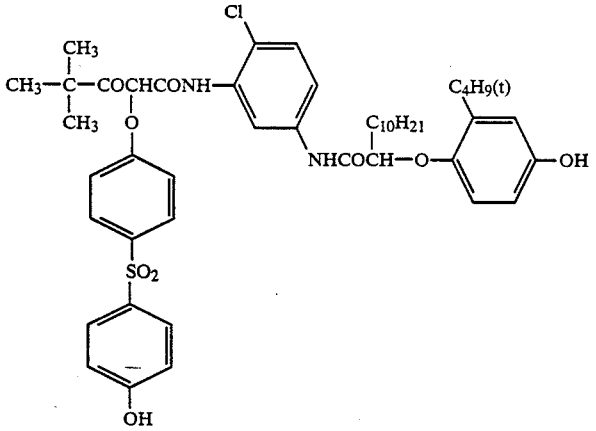
(Y-35)
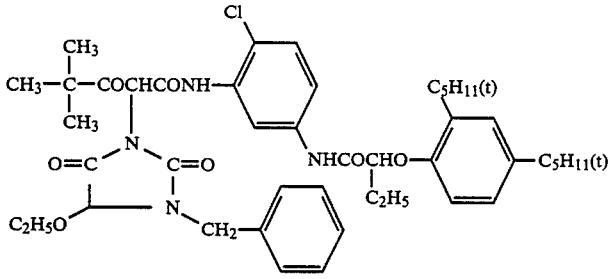
(Y-36)
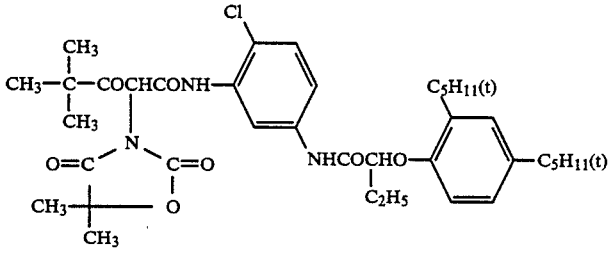

-continued
(Y-37)
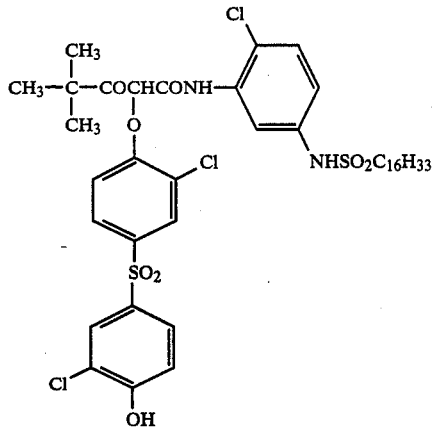
(Y-38)
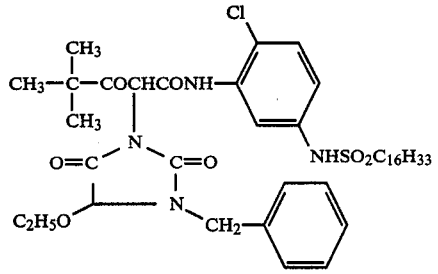
(Y-39)
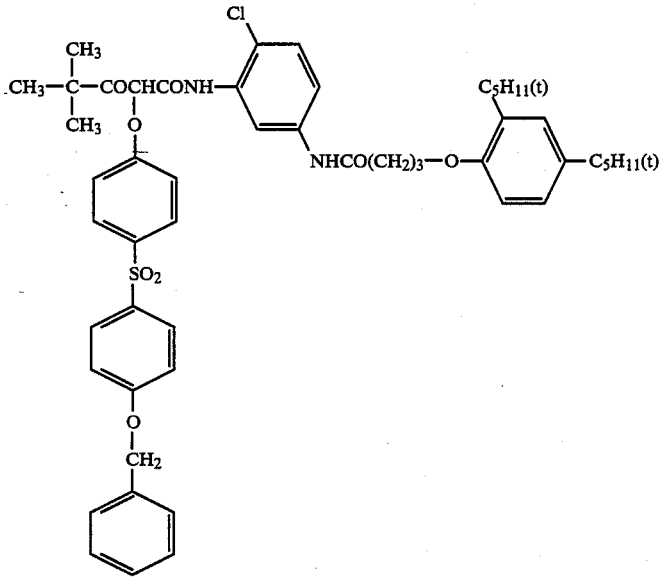
(Y-40)
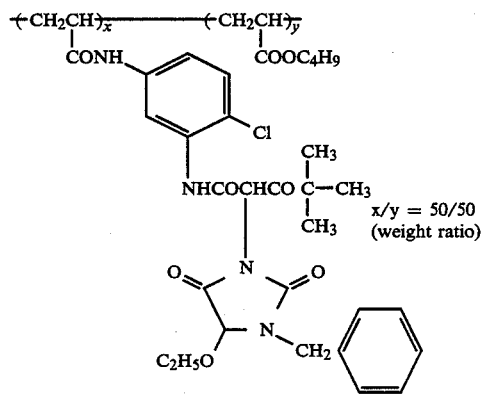

-continued
(Y-41)
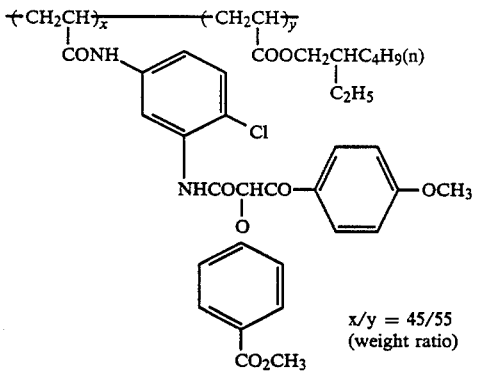
x/y = 45/55
(weight ratio)
(Y-42)
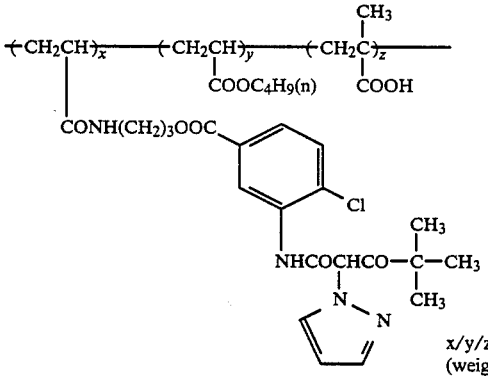
x/y/z = 50/45/5
(weight ratio)
(Y-43)
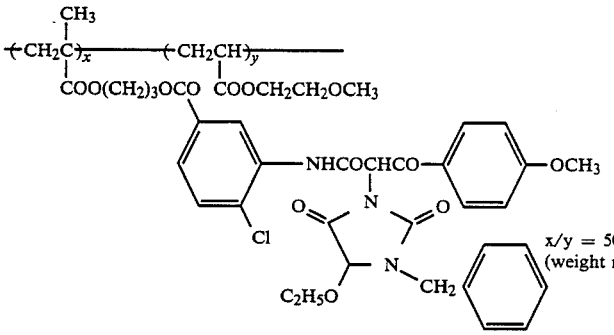
x/y = 50/50
(weight ratio)
(Y-44)
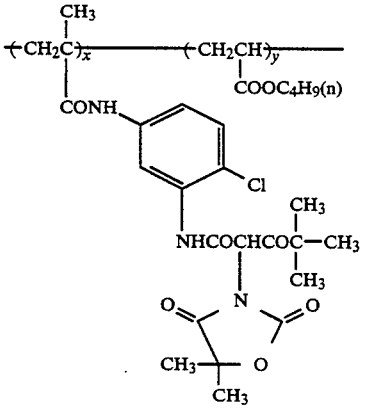
x/y = 50/50
(weight ratio)

-continued
(Y-45)
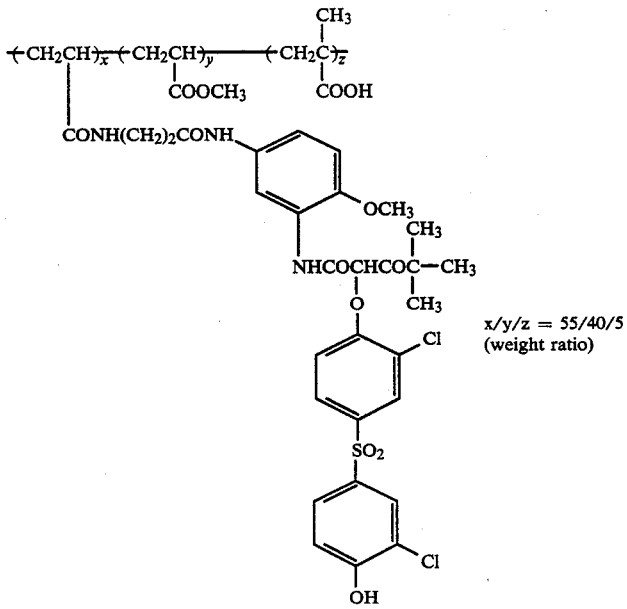
(Y-46)
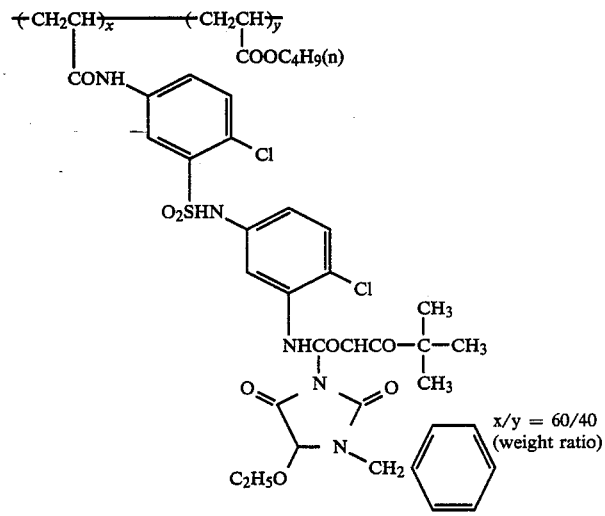
(Y-47)
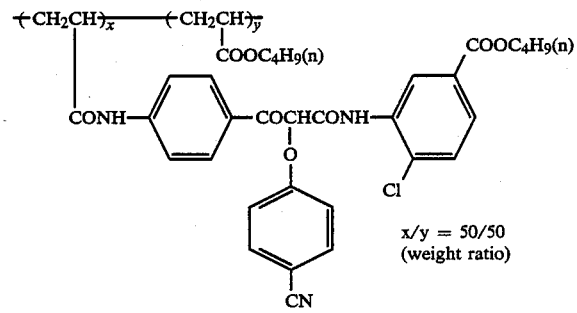

-continued (Y-48)

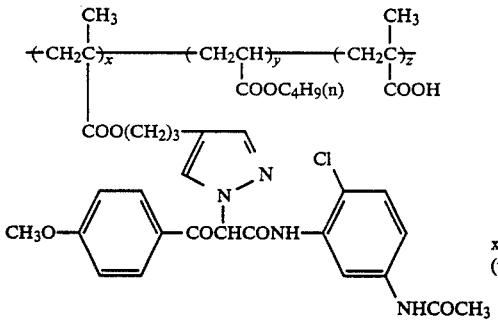

x/y/z = 60/30/10
(weight ratio)

(Y-49)

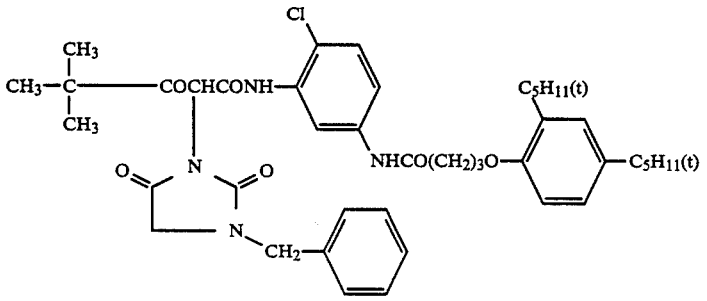

Publications in which other examples of couplers represented by general formula (III) through (VII) or synthesis methods therefor an described are mentioned below.

Cyan couplers represented by general formula (III) and (IV) can be synthesized in a known manner. For example, cyan couplers represented by general formula (III) can be synthesized by the methods described in U.S. Pat. Nos. 2,423,730 and 3,772,002. Cyan couplers represented by general formula (IV) can be synthesized by the methods described for example in U.S. Pat. Nos. 2,895,826, 4,333,999, and 4,327,173.

Magenta couplers represented by general formula (V) can be synthesized by the methods described for example in Japanese Patent Application (OPI) Nos. 74027/1974 and 74028/1974, Japanese Patent Publication Nos. 27930/1973 and 33846/1978, U.S. Pat. No. 3,519,429. Magenta couplers represented by general formula (VI) can be synthesized by the methods described for example in Japanese Patent Application (OPI) No. 162548/1984, U.S. Pat. No. 3,725,067, Japanese Patent Application (OPI) Nos. 171,956/1984 and 33,552/1985.

Yellow couplers represented by general formula (VII) can be synthesized by the methods described for example in Japanese Patent Application (OPI) No. 48541/1979, Japanese Patent Publication No. 10739/1983, U.S. Pat. No. 4,326,024, Research Disclosure 18053.

Couplers used in the present invention may include colored couplers having an effect for correcting color, couplers that release a development restrainer with the development (the so-called DIR couplers). The couplers may be those which form by the coupling reaction of colorless products.

Colored couplers which can be used include, for example, those described in U.S. Pat. Nos. 3,476,560, 2,521,908 and 3,034,892, Japanese Patent Publication Nos. 2016/1969, 22335/1963, 11304/1967 and 32461/1969, Japanese Patent Application (OPI) Nos. 26034/1976 and 42121/1977, and West Germany Patent Application (OLS) No. 2,418,959.

DIR couplers which can be used include, for example, those described in U.S. Pat. Nos. 3,227,554, 3,617,291, 3,701,783, 3,790,384 and 3,632,345, West Germany Patent Application (OLS) Nos. 2,414,006, 2,454,301 and 2,454,329, British Pat. No. 953,454, Japanese Patent Application (OPI) Nos. 69624/1977 and 122335/1974 and Japanese Patent Publication No. 16141/1976.

In addition to DIR couplers, a compound that releases a development restrainer with the development can be contained in the photosensitive material, and for example those described in U.S. Pat. Nos. 3,297,445, and 3,379,529, West Germany Patent Application (OLS) No. 2,417,914, and Japanese Patent Application (OPI) Nos. 15271/1977 and 9116/1978 can be used.

The present invention is particularly effective when combined with the magenta couplers represented by general formula (V) or (VI).

These couplers are generally added in an amount of $2\times10^{-3}$ to $5\times10^{-1}$ mol, preferably $1\times10^{-2}$ to $5\times10^{-1}$ mol, per mol of silver in the emulsion.

Preferably as a silver halide ingredient of the silver halide grain composition according to the present invention is used silver chlorobromide or silver bromochloroiodide. A mixture of silver chloride and silver bromide or the like may be used. In the present invention, if the silver halide emulsion is used for color photographic paper, since a particularly high developing speed and excellent processability are required, it is preferable that the halogen composition of the silver halide contains chlorine atoms, and the composition comprises preferably silver bromochloride or silver bromochloroiodide containing at least 1 mol % of silver chloride. Particularly preferably the content of silver chloride is 10 mol % or over. If the silver halide used in the present invention is silver bromochloroiodide, it is preferable that the content of silver iodide is up to 2 mol %.

In the application of the present invention, the following known fading preventive agents can be additionally used, and the dye stabilizers used in the present invention can be used alone or in combination. As known fading preventive agents can be mentioned, for example, hydroquinone derivatives described in U.S. Pat. Nos. 2,360,290, 2,418,613, 2,675,314, 2,701,197, 2,704,713, 2,728,659, 2,732,300, 2,735,765, 2,710,801, and 2,816,028, British Pat. No. 1,363,921, etc., gallic acid derivatives described in U.S. Pat. Nos. 3,457,079, and 3,069,262, etc., p-alkoxyphenols described in U.S. Pat. Nos. 2,735,765 and 3,698,909, Japanese Patent Publication Nos. 20977/1974 and 6623/1977, p-oxyphenol derivatives described in U.S. Pat. Nos. 3,432,300, 3,573,050, 3,574,627 and 3,764,337, Japanese Patent Application (OPI) Nos. 35633/1977, 14743/1977 and 152225/1977 and bisphenols described in U.S. Pat. No. 3,700,455.

To introduce a dye stabilizer of the present invention into a photographic layer of color photosensitive material, the compound can be added, for example, without being emulsified, directly to a silver halide emulsion or to a mixture solution of a coupler dispersion with dissolving into a low boiling point organic solvent such as ethyl acetate or ethanol to be emulsified. However, it is desirable that a dye stabilizer of the present invention is dissolved together with a coupler into a high boiling point solvent such as dibutylphthalate and tricresyl phophalate if desired, in the presence of a low boiling point co-solvent, to be used as an emulsified dispersion wherein the compound is emulsified and dispersed in an oil droplet in a water-soluble protective colloid such as gelatin or the like. Alternatively only a dye stabilizer of the present invention is emulsified and the emulsion together with a coupler dispersion is added to a silver halide emulsion.

As photographic layers to which a dye stabilizer of the present invention will be added can be mentioned a coupler-containing silver halide photosensitive emulsion layer (e.g., a red-sensitive silver halide emulsion layer, a green-sensitive silver halide emulsion layer and a blue-sensitive silver halide emulsion layer), a non-photosensitive photographic auxiliary layer (e.g., a protective layer, a filter layer, an intermediate layer, a subbing layer, etc.), although the dye stabilizer of the present invention is preferably placed in a magenta coupler-containing photographic layer, that is, the dye stabilizer is particularly effective to prevent a magenta image from fading or discoloring.

Typical examples of high boiling point organic solvents used in dissolving the dye stabilizers of the present invention alone or in combination with a coupler are butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate, trioctadecyl phosphate, etc. described in U.S. Pat. No. 3,676,137, diethyl succinate, dioctyl adipate, 3-ethylbiphenyl, and liquid dye stabilizers described in Product Licensing Index, Vol. 83, pages 26–29 (March 1971) under the name of "improved photographic dye image stabilizers."

Examples of low boiling point organic solvents used as co-solvents with a high boiling point organic solvent are ethyl acetate, butyl acetate, ethyl propionate, ethyl formate, butyl formate, nitroethane, carbon tetrachloride, chloroform, hexane, cyclohexane, ethylene glycol, acetone, ethanol, dimethylformamide, dioxane, etc. to which benzene, toluene, xylene or the like may be added.

Examples of surface active agents used in dispersing a solution containing the dye stabilizer used in the present invention alone or in combination with a coupler into an aqueous protective colloid include saponin, sodium alkyl sulfosuccinates, sodium alkyl benzenesulfonates, etc. and as examples of hydrophilic protective colloids can be mentioned gelatin (lime gelatin and gelatin treated with an acid can be used), casein, carboxymethylcellulose, polyvinyl alcohol, polyvinyl pyrrolidone, styrene-maleic anhydride copolymer, a condensate of styrene-maleic anhydride copolymer with polyvinyl alcohol,polyacrylates, ethylcellulose, etc., but the invention is not limited to those.

Bases used for the present invention include a cellulose nitrate film, cellulose acetate film, cellulose acetate butylate film, cellulose acetate propionate film, polystyrene film, polyethylene terephthalate film and polycarbonate film, a base laminated with these film,thin glass film, paper, etc. which are used generally for photographic materials. Baryta paper or papers to which $\alpha$-olefin polymer, particularly a polymer of $\alpha$-olefin having 2 to 10 carbon atoms for example polyethylene, polypropylene, ethylene/butene copolymer, etc. is applied or laminated bases and plastic films, in which the surface is roughened as described in Japanese Patent Publication No. 19068/1972 so as to render the adhesion to other high polymers improved, will give a favorable result.

Of these bases, a transparent one or opaque one is selected depending on the photosensitive material. A dye or pigment may be added to the base to be colored.

Examples of the opaque bases include opaque materials by nature such as paper, materials in which transparent films are coated with pigments such as dyes or titanium oxide, plastic films which has been subjected to a surface processing in a manner described in Japanese Patent Publication No. 1906/1972, and paper as well as plastic films in which carbon black, a dye or the like is blended so as to obtain a perfect light shielding property. The base is usually provided with a primer coat. For the purpose of further improving adhesion properties of the base surface, preliminary treatment may be carried out thereon by a corona discharge, an ultraviolet irradiation, a flame treatment or the like.

In the practice of the present invention, it is preferred, as usual, to form an ultraviolet ray absorbing layer additionally on the surface of a photographic light-sensitive emulsion layer which is an image forming layer, since the absorbing layer is effective to prevent an image from discoloration or fading by a light.

Further, the present invention is not limited with respect to the kinds of color processing agents such as a color developing agent, a bleaching agent and a fixer which are conventionally used. In particular, a silver saving type color photographic material disclosed in U.S. Pat. No. 3,902,905 can be applied advantageously to the present invention. Additionally in the present invention, no limitation is put on any kinds of intensification agents for color intensification processing.

The color photographic materials which the present invention can apply include usual color light-sensitive materials, particularly color photographic paper. In the present invention, there may be applied color photographic systems, particularly color diffusion transfer photographic systems disclosed in U.S. Pat. Nos.

3,227,550, 3,227,551 and 3,227,552, and U.S. Provisional Publication Patent U.S., B 351,673.

In order to obtain dye image of the color photographic material of the present invention, the photographic material must be subjected to color photographic development treatment after an exposure step. The color photographic development treatment is composed basically of a color development, a bleaching process and a fixing step. The two steps of the latter can be carried out at a time. Alternatively, an order of the color development, a first fixing process and a bleaching/fixing process is practicable. The development treatment step,if desired, may comprise a combination of steps of prehardening bath, neutralizer bath, a first development (black and white development) bath, image stabilizing bath and washing. Processing temperature is 18° C. or more in many cases. The processing temperature often used is within the range of 20° to 60° C., in recent years particularly within the range of 30° to 60° C.

The color developing solution is an aqueous alkaline solution containing an aromatic primary amine color developing agent and having a pH of 8 or more, preferably a pH of 9 to 12. Typical and preferably examples of the above color developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-β-methoxyethylaniline, 4-amino-3-methoxy-N-ethyl-N-β-methoxyethylaniline, 4-amino-3-β-methanesulfoamidoethyl-N,N-diethylaniline and their salts (e.g., sulfates, hydrochlorides, sulfites, p-toluene sulfonates and the like). Other usable color developing agents are disclosed in U.S. Pat. Nos. 2,193,015 and 2,592,364, Japanese Patent Application (OPI) No. 64933/1973 and L. F. A. Mason, "Photographic Processing Chemistry", Focal Press London, 1966, p. 22–229.

The color developing solution, in addition, can contain a pH buffer such as a sulfite, a carbonate, a borate or a phosphate of an alkaline metal, as well as a development restrainer or an antifoggant such as a bromide, an iodide or an organic antifoggant.

Concrete examples of the antifoggants used in the present invention include potassium bromide, potassium iodide; nitrobenzimidazoles, mercaptobenzimidazole, 5-methyl-benztriazole and 1-phenyl-5-mercaptotetrazole disclosed in U.S. Pat. Nos. 2,496,940 and 2,656,271; compounds disclosed in U.S. Pat. Nos. 3,113,864, 3,342,596, 3,295,976, 3,615,522 and 3,597,199; thiosulfonyl compounds disclosed in British Pat. No. 972,211; phenazine-N-oxides disclosed in Japanese Patent Publication No. 41675/1971, and antifoggants disclosed in Kagaku Shashin Benran (Science Photographic Handbook), Middle Volume, P. 29–47.

Moreover, the color developing solution may contain, if necessary, a water softener, a preservative such as hydroxylamine or DABCO (1,4-diazabicyclo [2,2,2] octane), an organic solvent such as benzyl alcohol or diethylene glycol, a development accelerator such as a polyethylene glycol, a quaternary ammonium salt or an amine, a dye forming coupler, a competing coupler, a fogging agent such as sodium borohydride, an auxiliary developing agent such as 1-phenyl-3-pyrazolidone and a viscosity imparting agent.

In the case that benzyl alcohol is contained in the color developing solution, the content of the benzyl alcohol is preferably 2.0 ml/l or less, more preferably 0.5 ml/l or less. It is rather desirable that no benzyl alcohol is added thereto at all. A color developing period of time is preferably 2 minutes and 30 seconds or less, more preferably within the range of 30 seconds to 2 minutes and 30 seconds. The most preferable color developing time is between 45 seconds and 2 minutes.

The color photographic material of the present invention is subjected to a usual color development, but in the present invention, the following color intensification development technique can be applied: For example, a method of using peroxides disclosed in U.S. Pat. Nos. 3,674,490 and 3,761,265, West German Patent Application (OLS) No. 2,056,360, Japanese Patent Application (OPI) Nos. 6338/1972, 10538/1972, 13335/1977, 13334/1977 and 13336/1977; another method of using cobalt complexes disclosed in West German Patent Application (OLS) No. 2,226,770, Japanese Patent Application (OPI) Nos. 9728/1973, 9729/1973, 6026/1976, 94822/1976, 133023/1976, 7728/1977 and 11034/1977; and still another method of using chlorous acid disclosed in Japanese Patent Publication No. 14625/1977, Japanese Patent Application (OPI) Nos. 99022/1976 and 103430/1976.

After the color development, the photographic emulsion layer is usually subjected to bleaching. The bleaching may be carried out simultaneously with fixing or separately therefrom. Usable examples of bleaching agents include compounds of polyvalent metals such as iron (III), cobalt (III), chromium (VI) and copper (II), peracids, quinones and nitroso compounds. Examples of the bleaching agents include ferricyanides, dichromates, organic complexes of iron (III) and cobalt (III); for examples, complexes of aminopolycarboxylic acids such as ethylenediaminetetraacetic acid, nitrilotriacetic acid, 1,3-diamino-2-propanoltetraacetic acid; complexes of organic acids such as citric acid, tartaric acid and malic acid; persulfates and permanganates; and nitrosophenols. Of these compounds, potassium ferricyanide, iron (III) sodium ethylenediaminetetraacetate and iron (III) ammonium ethylenediaminetetraacetate are particularly useful. (Ethylenediaminetetraacetato)iron (III) complex is useful in an independent bleaching bath and in one bleaching/fixing bath.

The bleach-fix processing can be carried out at an arbitrary temperature of 18° to 50° C., but its processing temperature preferably is 30° C. or over. When it is at a level of 35° C. or over, a processing time can be shortened up to 1 minute or less, and a supplemetary amount of a liquid can be reduced. A time necessary for washing after the bleach-fix step is usually 3 minutes or less, but when a stabilizing bath is employed, such a washing operation is not required substantially.

To the bleaching bath or the bleach-fix bath, a bleach accelerator and other various additives can be added which are disclosed in U.S. Pat. Nos. 3,042,520 and 3,241,966 as well as Japanese Patent Publication Nos. 8506/1970 and 8836/1970.

In the silver halide color photographic material of the present invention, a color image thereon does not discolor for a long period of time, and a white background on the color image can be prevented from causing yellow stain. Therefore, it is fair to say that the silver halide color photographic material of the present invention has an excellent and high preservability.

In the color photographic material of the present invention, a discoloration inhibitor does not cause any change in a hue and any photographic fog, and has an effect sufficient to prevent a dye image from changing and discoloration.

Now, the present invention will be described in detail in accordance with examples, but the latter do not intend to limit the scope of the present invention.

EXAMPLE 1

In a solution of 20 ml of tricresyl phosphate and 20 ml of ethyl acetate was dissolved 10 g of Magenta coupler M-1, and the resulting solution was emulsified and dispersed in 80 g of a gelatin solution containing 8 ml of a 1% aqueous sodium dodecylbenzenesulfonate.

This resultant emulsified dispersion was mixed with 145 g of a green-sensitive silver chlorobromide emulsion (Br content 50 mol%, Ag content 7 g), and sodium dodecylbenzene-sulfonate as a coating auxiliary was added thereto. A paper base both the surfaces of which had previously been laminated with a polyethylene film was coated with the resulting mixture.

A coating amount of the coupler was 400 mg/m$^2$. Then, a gelatin protective layer (gelatin contant 1 g/m$^2$) was provided over this layer in order to form a sample A.

In the similar manner, emulsified dispersions were prepared each of which was composed of a combination of Magenta coupler M-17, M-23 or M-31 and a compound having a general formula (I) or (II) or a comparative compound. The compound represented by the general formula (I) or (II) or the comparative compound was added in an amount of 50 mol% with respect to the coupler employed, and the same procedure as in the case of preparing the Sample A was repeated with the exception that stabilizers were exchanged, in order to prepare samples B to T.

These samples were exposed to a light of 1,000 lux for one second and were then treated with the following processing solution:

| | |
|---|---|
| Developing solution | |
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N—ethyl-N—β-(methanesulfonamido)-ethylaniline.3/2$H_2SO_4$.$H_2O$ | 4.5 g |
| Water q.s. | 1,000 ml |
| (pH = 10.1) | |
| Bleach-fix Solution | |
| Ammonium thiosulfate (70 wt %) | 150 ml |
| $Na_2SO_3$ | 5 g |
| Na[Fe(EDTA)] | 40 g |
| EDTA | 4 g |
| Water q.s | 1,000 ml |
| (pH = 6.8) | |

| Processing Conditions | Temperature | Time |
|---|---|---|
| Developing solution | 33° C. | 3 min 30 sec |
| Bleach-fix solution | 33° C. | 1 min 30 sec |
| washing | 28 to 35° C. | 3 min |

For each sample formed with a dye image thereon, a fading test was carried out for 6 days by the use of a xenon tester (illumination 200,000 lux) with an ultraviolet absorbing filter (Produced by Fuji Photo Film) for cutting off a wave range of 400 nm and less. A density variation of each sample at the portion having an initial density of 2.0 was measured by a Macbeth densitometer RD-514 model (Status AA Filter), and the results are set forth in Table 1.

TABLE 1

| Sample | Magenta Coupler | Dye Stabilizer | Variation in Magenta Density (Initial Density 2.0) | Remarks |
|---|---|---|---|---|
| A | M-1 | — | −1.73 | Comparative example |
| B | " | Comparative compound (A) | −0.55 | Comparative example |
| C | " | Comparative compound (B) | −0.49 | Comparative example |
| D | " | Comparative compound (C) | −0.90 | Comparative example |
| E | " | Compound (6) | −0.29 | This invention |
| F | " | Compound (17) | −0.27 | " |
| G | M-17 | — | −1.98 | Comparative example |
| H | " | Comparative compound (A) | −0.73 | Comparative example |
| I | " | Comparative compound (B) | −0.44 | Comparative example |
| J | " | Comparative compound (C) | −0.50 | Comparative example |
| K | " | Compound (6) | −0.21 | This invention |
| L | " | Compound (17) | −0.23 | " |
| M | M-23 | — | −1.75 | Comparative example |
| N | " | Compound (6) | −0.19 | This invention |
| O | " | Compound (10) | −0.22 | " |
| P | " | Compound (12) | −0.21 | " |
| Q | M-31 | — | −1.83 | Comparative example |
| R | " | Compound (1) | −0.24 | This invention |
| S | " | Compound (10) | −0.23 | " |
| T | " | Compound (12) | −0.22 | " |

Comparative Compound (A)

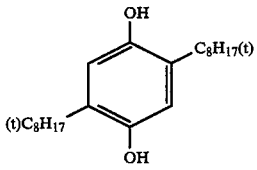

Comparative Compound (B)

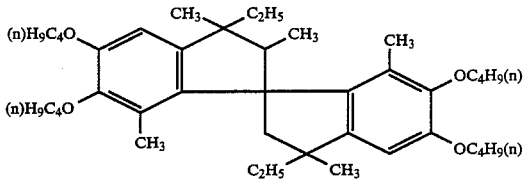

Compound described in U.S. Pat. No. 4,360,589

Comparative Compound (C)

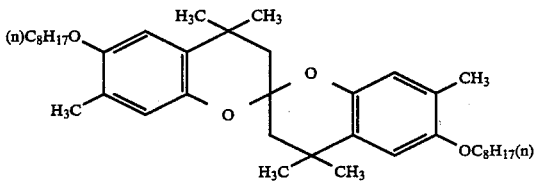

EXAMPLE 2

By the use of Magenta coupler M-25, a coating composition for a third layer in Table 3 was prepared in accordance with the same procedure as in the case of preparing the sample A in Example 1. Using the coating composition in the third layer, multi-layer sample having structure shown in Table 3 was prepared. On the other hand, in the same manner as the above five pieces of multi-layer samples b to f containing dye stabilizers of the present invention shown in Table 2 and/or comparative compounds in the third layer were prepared. These samples were exposed to a light and processed as in Example 1. The developed dye images of the respective samples thus obtained were subjected to a fading test by exposure with a fluorescent lamp type fading device (15,000 lux) for 4 weeks, and a density variation of each sample at the portion having an initial density of 1.0 was measured. The results are set forth in Table 2.

These results indicate that the compounds of the present invention have the great effect that the dye images are prevented from fading by light.

On the other hand, after these samples were subjected to another blue-green-red three-color separation exposure, the same processing as in Example 1 was carried out. Then, their hues of the magenta colors were compared with each other, and it was found that the samples b to d formed all the same excellent hues as that of the sample a. This fact elucidated that the addition of the compounds regarding the present invention has no influence on the hue at all.

TABLE 2-continued

| Sample | Dye Stabilizer | Amount (mol %/ coupler) | Variation in Magenta Density (Initial Density = 1.0) | Remarks |
|---|---|---|---|---|
| | compound (C) | | | example |
| | Comparative compound (D) | | | |

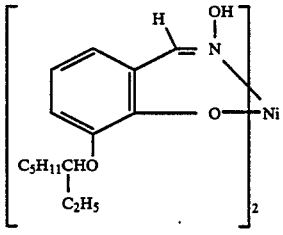

TABLE 3

| | |
|---|---|
| Seventh Layer | gelatin (coating amount 1,600 mg/m$^2$) |
| Sixth Layer | gelatin (coating amount 1,000 mg/m$^2$)<br>ultraviolet absorbing agent (*1) (coating amount 360 mg/m$^2$)<br>ultraviolet absorbing solvent (*2) (coating amount 120 mg/m$^2$) |
| Fifth Layer | silver chlorobromide emulsion (Br 50 mol %, silver coating amount 250 mg/m$^2$), gelatin (coating amount 1,200 mg/m$^2$), cyan coupler (*3) (coating amount 500 mg/m$^2$)<br>coupler solvent (*2) (coating amount 250 mg/m$^2$) |
| Fourth Layer | gelatin (coating amount 1,600 mg/m$^2$)<br>ultraviolet absorbing agent (*1) (coating amount 700 mg/m$^2$)<br>color mixing inhibitor (*4) (coating amount 200 mg/m$^2$)<br>solvent (*2) (coating amount 300 mg/m$^2$) |
| Third Layer | silver chlorobromide emulsion (Br 50 mol %, silver coating amount 180 mg/m$^2$)<br>magenta coupler (*5) (coating amount 320 mg/m$^2$),<br>coupler solvent (*6) (coating amount 320 mg/m$^2$) |
| Second Layer | gelatin (coating amount 1,100 mg/m$^2$)<br>color mixing inhibitor (*4) (coating amount 200 mg/m$^2$)<br>solvent (*2) (coating amount 100 mg/m$^2$) |
| First Layer | silver chlorobromide emulsion (Br 80 mol %, silver coating amount 350 mg/m$^2$), gelatin (coating amount 1,500 mg/m$^2$), yellow coupler (*7) (coating amount 500 mg/m$^2$)<br>coupler (*8) (coating amount 400 mg/m$^2$) |
| Base | paper base both the surfaces of which were laminated with a polyethylene film |

(*1) Ultraviolet absorbing agent: 2-(2-hydroxy-3-sec-butyl-5-tert-butylphenyl)benzotriazole
(*2) Solvent: dibutyl phthalate (UV-21)
(*3) Cyan coupler: 2-[α-(2,4-di-tert-pentylphenoxy)-butaneamide]-4,6-dichloro-5-methylphenol
(*4) Color mixing inhibitor: 2,5-dioctylhydroquinone
(*5) Magenta coupler: M-25
(*6) Coupler solvent: tricresyl phosphate
(*7) Yellow coupler: α-pivaloyl-α-(2,4-dioxo-5,5'-dimethyloxazoline-3-yl)-2-chloro-5-[α-(2,4-di-tert-pentylphenoxy)butaneamide]acetoanilide
(*8) Coupler solvent: dioctylbutyl phosphate

TABLE 2

| Sample | Dye Stabilizer | Amount (mol %/ coupler) | Variation in Magenta Density (Initial Density = 1.0) | Remarks |
|---|---|---|---|---|
| a | — | — | −0.44 | Comparative example |
| b | Compound (6) | 50 | −0.14 | This invention |
| c | Compound (6) | 100 | −0.08 | This invention |
| d | Compound (6) | 100 | −0.06 | This invention |
| | Comparative compound (D) | 5 | | |
| e | Comparative compound (B) | 100 | −0.18 | Comparative example |
| f | Comparative | 100 | −0.29 | Comparative |

EXAMPLE 3

A sample g was prepared by the same procedure as in Example 1 with the exception that the magenta coupler of the sample A in Example 1 was replaced with Cyan coupler C-1 and that the green-sensitive silver chlorobromide emulsion was replaced with a red-sensitive silver chlorobromide (Br content 50 mol %).

Other samples were similarly prepared by adding a dye stabilizer in an amount of 50 mol % based on the coupler. Exposere and development were carried out in the same manner as in Example 1.

For each sample formed with a dye image thereon, fastness to light was inspected by exposing the sample for 500 hours by the use of a xenon tester (illumination 100,000 lux) with an ultraviolet absorbing filter (Produced by Fuji Photo Film) for cutting off a wave range of 400 nm and less. After the exposure, for the samples at the portion having an initial density of 2.0, dye residual percents were measured.

Further, for the inspection of heat resistance, samples were stored in a dark place at 100° C. for 100 hours, and dye residual percents at the portion having an initial density of 2.0 were then measured.

TABLE 4

| Sample | Antioxidant | Dye Residual Percent after 500 hours' Xenon Exposure | Dye Residual Percent after 100 hours' Storage at 100° C. | Remarks |
|---|---|---|---|---|
| g | — | 59% | 52% | Blank |
| h | Compound (6) | 83% | 78% | This invention |
| i | Compound (12) | 84% | 75% | This invention |
| j | 2,6-di-tert-butyl-4-methylphenol | 63% | 59% | Comparative example |
| k | 2,2,6,6-tetramethyl-4-piperidinol | 61% | 56% | Comparative example |

EXAMPLE 4

A sample l was prepared by the same procedure as in Example 1 with the exception that the magenta coupler of the sample A in Example 1 was replaced with Yellow coupler Y-35 and that the green-sensitive silver chlorobromide emulsion was replaced with a blue-sensitive silver chlorobromide (Br content 80 mol %). Other samples m~p were similarly prepared by adding a dye stabilizer in an amount of 50 mol % based on the coupler.

Exposure and development were carried out in the same manner as in Example 1.

For the inspection of fastness to light, a xenon tester was used as in Example 3. That is, the samples at the portion having a dye initial density of 2.0 were exposed to light and then dye residual percents were measured. Further, for the inspection of heat resistance, the samples were stored in a dark place at 100° C. for 500 hours and then dye residual percents at the portion having an initial density of 2.0 were measured. The results are set forth in Table 5.

| Sample | Antioxidant | Dye Residual Percent after 200 hours' Xenon Exposure | Dye Residual Percent after 500 hours' Storage at 100° C. | Remarks |
|---|---|---|---|---|
| l | — | 72% | 90% | Blank |
| m | Compound (9) | 94% | 96% | This invention |
| n | Compound (15) | 92% | 95% | This invention |
| o | 2,6-di-tert-butyl-4-methylphenol | 74% | 90% | Comparative example |
| p | 2,2,6,6-tetramethyl-4-piperidinol | 72% | 91% | Comparative example |

As is apparent from the above results in Examples 1 to 4, the effect of improving fastness of the dye image with respect to cyan, magenta and yellow are superior to that of known compounds having similar chemical structures. Particularly with respect to the cyan and the yellow dye images, a heat-resistant fastness is also excellent in the present invention.

Having described our invention as related to the embodiment, it is our intention that the invention is not limited by any of the details of the description, unless otherwise specified, but rather be construed broadly within its spirit and scope as set out in the accompanying claims.

What we claim is:

1. A silver halide color photographic material, comprising at least one of the compounds represented by formula (I) or (II):

formula (I)

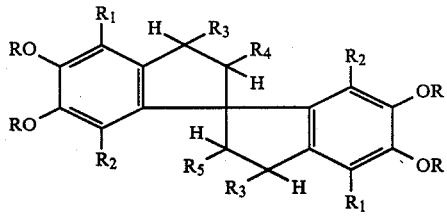

formula (II)

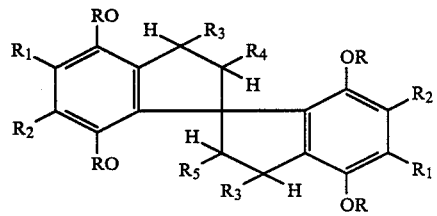

wherein each R represents a hydrogen atom, an alkyl group, alkenyl group, aryl group, heterocyclic ring group, $R_6CO$— group, $R_7SO_2$— group, or $R_8NHCO$— group in which $R_6$, $R_7$ and $R_8$ each represents an alkyl group, alkenyl group, aryl group or heterocyclic ring group; $R_1$ and $R_2$ each represents a hydrogen atom, halogen atom, alkyl group, alkenyl group, alkoxy group, alkenoxy group, aryloxy group, alkylthio group, alkenylthio group, arylthio group, alkoxycarbonyl group, alkylcarbonyl group, hydroxy group, alkylcarbonyloxy group, carbamoyl group or acylamino group;

$R_3$ represents a hydrogen atom, alkyl group, alkenyl group or aryl group; $R_4$ and $R_5$ each represents a hydrogen atom, alkyl group, alkenyl group, alkoxy group, alkenoxy group, aryloxy group, alkylthio group, alkenylthio group or arylthio group; each R, $R_1$, $R_2$ and $R_3$ in two compounds or in one compound represented by formula (I) and/or (II) may be the same or different; and in R, $R_1$ and $R_2$, adjacent groups may be joined to form a 5-membered or a 6-membered ring.

2. The silver halide color photographic material as claimed in claim 1, wherein in formula (I) and (II), R represents a hydrogen atom or an alkyl group; and $R_3$, $R_4$ and $R_5$ each is selected from the group consisting of a hydrogen atom, alkyl group and aryl group.

3. The silver halide color photographic material as claimed in claim 2, wherein $R_1$ and $R_2$ each is selected from the group consisting of a hydrogen atom, alkyl group, alkoxy group and hydroxy group.

4. The silver halide color photographic material as claimed in claim 1, wherein the compound represented by formula (I) or (II) is used in combination with at least one of hydroquinone derivatives, hydroxychroman derivatives, hydroxyspirochroman derivatives, hydroxychroman, derivatives wherein the hydroxyl group of hydroxyspirochroman is replaced by an alkoxy group, or alkoxyphenol derivatives.

5. The silver halide color photographic material as claimed in claim 1, further comprising a color coupler and wherein a dye stabilizer of formula (I) or (II) is contained in an amount of 0.5 to 200 wt. % based on said coupler.

6. The silver halide color photographic material as claimed in claim 1, wherein a dye stabilizer represented by formula (I) or (II) is contained in a coupler-containing silver halide photosensitive emulsion layer or a nonphotosensitive photographic auxiliary layer.

7. The silver halide color photographic material as claimed in claim 1, further comprising at least one coupler represented by formula [III], [IV], [V], [VI] or [VII]

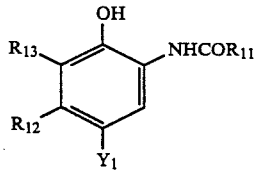

General formula (III)

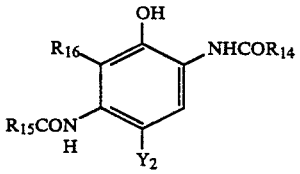

General formula (IV)

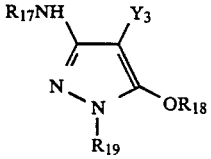

General formula (V)

-continued

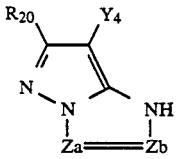

General formula (VI)

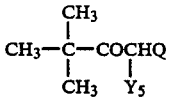

General formula (VII)

wherein $R_{11}$, $R_{14}$ and $R_{15}$ each represents an aliphatic group, aromatic group, heterocyclic group, aromatic amino group, or heterocyclic amino group; $R_{12}$ represents an aliphatic group; $R_{13}$ and $R_{16}$ each represents a hydrogen atom, halogen atom, aliphatic group, aliphatic oxy group or acylamino group; $R_{17}$ and $R_{19}$ each represents a substituted or unsubstituted phenyl group; $R_{18}$ represents a hydrogen atom, aliphatic or aromatic acyl group, or aliphatic or aromatic sulfonyl group; $R_{20}$ represents a hydrogen atom or a substituent; Q represents a substituted or unsubstituted N-phenylcarbamoyl group; Za and Zb each represents a methine group, substituted methine group or =N—; $Y_1$, $Y_2$, $Y_3$, $Y_4$ and $Y_5$ each represents a group capable of splitting off at the time of coupling reaction with the oxidation product of a developing agent; and $R_{12}$ and $R_{13}$, and $R_{15}$ and $R_{16}$ respectively may form a 5-membered, 6-membered or 7-membered ring.

8. The silver halide color photographic material as claimed in claim 7, wherein the coupler is a compound selected from the group consisting of formulas (V) and (VI).

9. The silver halide color photographic material as claimed in claim 1, wherein each R represents an alkyl group selected from the group consisting of methyl, ethyl, propyl, n-octyl, tert-octyl, benzyl, and hexadecyl, an alkenyl group selected from the group consisting of allyl, octenyl and oleyl, an aryl group selected from the group consisting of phenyl and naphthyl, or a heterocyclic ring group selected from the group consisting of tetrahydropyranyl and pyrimidyl.

10. The silver halide color photographic material as claimed in claim 1, wherein $R_6$, $R_7$ and $R_8$ each represents an alkyl group selected from the group consisting of methyl, ethyl, n-propyl, n-butyl, n-octyl, tert-octyl and benzyl, an alkenyl group selected from the group consisting of aryl, octenyl and oleyl, an aryl group selected from the group consisting of phenyl, methoxyphenyl and naphthyl, or a heterocyclic ring group selected from the group consisting of pyridyl and pyrimidyl.

11. The silver halide color photographic material as claimed in claim 1, wherein $R_1$ and $R_2$ each represents a halogen atom selected from the group consisting of fluorine, chlorine and bromine, an alkyl group selected from the group consisting of methyl, ethyl, n-butyl and benzyl, an alkenyl group selected from the group consisting of allyl, hexenyl and octenyl, an alkoxy group selected from the group consisting of methoxy, ethoxy and benzyloxy, an alkenoxy group selected from the group consisting of 2-propenyloxy and hexenyloxy, an aryloxy group selected from the group consisting of phenyloxy and naphthyloxy, an alkylthio group selected from the group consisting of ethylthio and butylthio, an alkenylthio group selected from the group consisting of 2-butenylthio and 2-pentenylthio, an arylthio group selected from the group consisting of phenylthio and naphthylthio, an alkoxycarbonyl group selected from the group consisting of methoxycarbonyl and butoxycarbonyl, an alkylcarbonyl group selected from the group consisting of acetyl and tetradecanoyl, an alkylcarbonyloxy group selected from the group consisting of acetyloxy and tetradecanoyloxy, a carbamoyl group selected from the group consisting of N-ethylcarbamoyl and N-methyl-N-dodecylcarbamoyl or an acylamino group selected from the group consisting of acetylamino and benzoylamino.

12. The silver halide color photographic material as claimed in claim 1, wherein $R_3$ represents an alkyl group selected from the group consisting of methyl, ethyl, n-butyl and benzyl, an alkenyl group selected from the group consisting of 2-propenyl, hexenyl and octenyl, or an aryl group selected from the group consisting of phenyl, methoxyphenyl, chlorophenyl and naphthyl.

13. The silver halide color photographic material as claimed in claim 1, wherein $R_4$ and $R_5$ each represents an alkyl group selected from the group consisting of methyl, ethyl and n-butyl, an alkenyl group selected from the group consisting of allyl and octenyl, an alkoxy group selected from the group consisting of methoxy and butoxy, an alkenoxy group selected from the group consisting of 2-propenyloxy and hexenyloxy, an aryloxy group selected from the group consisting of phenyloxy and naphthyloxy, an alkylthio group selected from the group consisting of ethylthio and butylthio, an alkenylthio group selected from the group consisting of 2-butenylthio and 2-pentenylthio, or an arylthio group selected from the group consisting of phenylthio and naphthylthio.

14. The silver halide color photographic material as claimed in claim 1, wherein $R_1$ and $R_2$ each represents a hydrogen atom, an alkyl group having 1–20 carbon atoms, an alkoxy group having 1–20 carbon atoms or a hydroxy group.

15. The silver halide color photographic material as claimed in claim 2, wherein R represents a hydrogen atom or an alkyl group having 1–20 carbon atoms, and $R_3$, $R_4$ and $R_5$ each represents a hydrogen atom, an alkyl group having 1–20 carbon atoms or an aryl group.

16. The silver halide color photographic material as claimed in claim 5, wherein the dye stabilizer is contained in an amount of 2 to 150 wt. % based on the coupler.

17. The silver halide color photographic material as claimed in claim 7, wherein dimers or higher polymers may be formed through $R_{11}$, $R_{12}$, $R_{13}$ or $Y_1$; $R_{14}$, $R_{15}$, $R_{16}$ or $Y_2$; $R_{17}$, $R_{18}$, $R_{19}$ or $Y_3$; $R_{20}$, $Z_a$, $Z_b$ or $Y_4$; and Q or $Y_5$.

18. The silver halide color photographic material as claimed in claim 7, wherein the aliphatic group represents linear, branched or cyclic alkyl, alkenyl or alkynyl groups.

19. The silver halide color photographic material as claimed in claim 8, wherein the coupler is added in an amount of $2\times10^{-3}$ to $5\times10^{-1}$ mol, per mol of silver.

* * * * *